US011840388B2

(12) United States Patent
Obana

(10) Patent No.: US 11,840,388 B2
(45) Date of Patent: Dec. 12, 2023

(54) MULTILAYERED CONTAINER AND INNER CONTAINER

(71) Applicant: SHISEIDO COMPANY, LTD., Tokyo (JP)

(72) Inventor: Takakazu Obana, Tokyo (JP)

(73) Assignee: SHISEIDO COMPANY, LTD., Tokyo (JP)

( * ) Notice: Subject to any disclaimer, the term of this patent is extended or adjusted under 35 U.S.C. 154(b) by 7 days.

(21) Appl. No.: 15/734,000

(22) PCT Filed: Jun. 12, 2019

(86) PCT No.: PCT/JP2019/023331

§ 371 (c)(1),
(2) Date: Dec. 1, 2020

(87) PCT Pub. No.: WO2019/240187

PCT Pub. Date: Dec. 19, 2019

(65) Prior Publication Data

US 2021/0214140 A1 Jul. 15, 2021

(30) Foreign Application Priority Data

Jun. 13, 2018 (JP) ..... 2018-113137

(51) Int. Cl.
*B65D 77/06* (2006.01)
*B05B 11/00* (2023.01)
(Continued)

(52) U.S. Cl.
CPC ..... *B65D 77/06* (2013.01); *A45D 34/00* (2013.01); *B05B 11/0038* (2018.08);
(Continued)

(58) Field of Classification Search
CPC ..... B05B 11/00412; B05B 11/0054; B05B 11/0038; B05B 11/3047; B05B 11/3001;
(Continued)

(56) References Cited

U.S. PATENT DOCUMENTS 687,790 A 12/1901 Scales
3,335,913 A * 8/1967 Bouet ..... B65D 83/38 222/95

(Continued)

FOREIGN PATENT DOCUMENTS

JP H05-094155 U 12/1993
JP H09-242987 9/1997

(Continued)

OTHER PUBLICATIONS

English Translation of the Description of JP 11342948 A as provided by https://worldwide.espacenet.com/ on May 13, 2022 (Year: 1998).*

(Continued)

*Primary Examiner* — Charles P. Cheyney
(74) *Attorney, Agent, or Firm* — IPUSA, PLLC

(57) ABSTRACT

A multilayered container includes an inner container configured to contain content, and an outer container configured to accommodate the inner container. The inner container has a side surface formed with a plurality of folded pleats contractable and expandable in a vertical direction, so that the inner container is shrinkable inside the outer container. The inner container includes a metal layer or an inorganic layer. A discharge mechanism, configured to discharge the content, and including a mechanism configured to prevent air from entering the inner container when discharging the content, is attached to an upper surface of the inner container.

12 Claims, 14 Drawing Sheets

(51) Int. Cl.

| | |
|---|---|
| ***A45D 34/00*** | (2006.01) |
| ***B65D 21/08*** | (2006.01) |
| ***B65D 43/02*** | (2006.01) |
| *B05B 11/10* | (2023.01) |

(52) U.S. Cl.
CPC ..... *B65D 21/086* (2013.01); *B65D 43/0231* (2013.01); *A45D 2200/056* (2013.01); *B05B 11/1001* (2023.01); *B05B 11/1047* (2023.01); *B65D 2543/00092* (2013.01)

(58) Field of Classification Search
CPC .. B65D 77/06; B65D 21/086; B65D 43/0231; A45D 34/00
USPC ..... 222/95, 105, 183
See application file for complete search history.

(56) References Cited

U.S. PATENT DOCUMENTS

| | | | | | |
|---|---|---|---|---|---|
| 3,791,557 | A * | 2/1974 | Venus, Jr. | B65D 83/0061 | 222/105 |
| 3,838,796 | A * | 10/1974 | Cohen | B65D 83/0077 | 222/105 |
| 3,876,115 | A * | 4/1975 | Venus, Jr. | B65D 83/0061 | 222/386.5 |
| 4,062,475 | A * | 12/1977 | Harris | B65D 83/62 | 239/323 |
| 4,322,020 | A * | 3/1982 | Stone | B05B 11/026 | 222/394 |
| 4,492,313 | A | 1/1985 | Touzani | | |
| 4,790,361 | A | 12/1988 | Jones et al. | | |
| 4,797,309 | A | 1/1989 | Kammerer et al. | | |
| 5,102,010 | A | 4/1992 | Osgar et al. | | |
| 5,201,438 | A | 4/1993 | Norwood | | |
| 5,238,150 | A * | 8/1993 | Williams | B65D 83/0077 | 222/386 |
| 5,279,447 | A * | 1/1994 | Petschek | F02K 9/50 | 222/105 |
| 5,310,068 | A | 5/1994 | Saghri | | |
| 5,333,761 | A | 8/1994 | Davis et al. | | |
| 5,348,173 | A | 9/1994 | Norwood | | |
| 5,642,838 | A * | 7/1997 | Stoody | B05B 11/00412 | 222/105 |
| 5,875,936 | A * | 3/1999 | Turbett | B05B 11/0094 | 222/536 |
| 5,960,993 | A | 10/1999 | Mitsui et al. | | |
| 6,223,932 | B1 | 5/2001 | Usui | | |
| 6,598,755 | B1 | 7/2003 | Pedulla et al. | | |
| 6,601,732 | B1 | 8/2003 | Rooney et al. | | |
| 6,648,244 | B2 * | 11/2003 | Yu | B05B 11/026 | 239/323 |
| 6,840,164 | B2 | 1/2005 | Eastman | | |
| 7,140,518 | B2 * | 11/2006 | Wang | B05B 9/0838 | 222/326 |
| 7,661,565 | B2 | 2/2010 | Jackman | | |
| 7,866,500 | B1 | 1/2011 | Peggs | | |
| 7,963,955 | B2 | 6/2011 | Freund et al. | | |
| 8,302,813 | B2 | 11/2012 | Chen | | |
| 8,550,300 | B2 * | 10/2013 | Lee | B05B 11/3074 | 222/105 |
| 8,596,448 | B2 | 12/2013 | Sempe | | |
| 8,695,850 | B2 | 4/2014 | Bowman et al. | | |
| 9,296,508 | B2 | 3/2016 | Kanfer et al. | | |
| 10,974,885 | B2 * | 4/2021 | Yamauchi | B05B 11/026 | |
| 2003/0006240 | A1 | 1/2003 | Higuchi | | |
| 2003/0075562 | A1 | 4/2003 | Gerenraich et al. | | |
| 2004/0040971 | A1 | 3/2004 | Athalye | | |
| 2005/0017015 | A1 | 1/2005 | Higuchi | | |
| 2009/0014471 | A1 * | 1/2009 | Lin | B05B 11/0043 | 222/96 |
| 2011/0036806 | A1 | 2/2011 | Gregg et al. | | |
| 2012/0227860 | A1 | 9/2012 | Jeremiah | | |
| 2013/0193164 | A1 | 8/2013 | Tom et al. | | |
| 2013/0200110 | A1 * | 8/2013 | Lee | B65D 83/0061 | 222/321.6 |
| 2014/0151396 | A1 * | 6/2014 | Stehli, Jr. | B65D 77/06 | 220/254.1 |
| 2014/0166650 | A1 | 6/2014 | Kanfer et al. | | |
| 2016/0023823 | A1 | 1/2016 | Barron | | |
| 2017/0173615 | A1 * | 6/2017 | Toh | B05B 11/0054 | |
| 2022/0062929 | A1 * | 3/2022 | Goettke | B05B 11/3047 | |

FOREIGN PATENT DOCUMENTS

| | | | | |
|---|---|---|---|---|
| JP | H11-043150 | | 2/1999 | |
| JP | H11-130072 | | 5/1999 | |
| JP | 11342948 | A * | 12/1999 | B65D 1/0292 |
| JP | H11-342948 | | 12/1999 | |
| JP | 2000-007031 | | 1/2000 | |
| JP | 2003-128041 | | 5/2003 | |
| JP | 2004-352327 | | 12/2004 | |
| JP | 3123074 | U | 7/2006 | |
| JP | 2008-213854 | | 9/2008 | |
| JP | 2010-126215 | | 6/2010 | |
| JP | 2011-011781 | | 1/2011 | |
| JP | 4769976 | | 9/2011 | |
| JP | 2013-540080 | | 10/2013 | |
| JP | 2014-231362 | | 12/2014 | |
| JP | 2015030526 | | 2/2015 | |
| TW | 201228897 | | 7/2012 | |
| WO | 2008/091149 | | 7/2008 | |
| WO | 2017/082115 | | 5/2017 | |

OTHER PUBLICATIONS

International Search Report for PCT/JP2019/023331 dated Sep. 10, 2019.

Ichiro Hagiwara et al., "Optimization for Crush Characteristics of Cylindrical Origami Structure Using Reversed Spiral Model", Papers by the Japan Society of Mechanical Engineers (Edition A), vol. 70, No. 689, Jan. 2004, pp. 36-42, with English abstract.

Ichiro Hagiwara et al., "Consideration on Crush Characteristics of Cylindrical Structures using Origami Engineering", Society of Automotive Engineers of Japan, Inc., vol. 34, No. 4, Oct. 2003, pp. 145-149, with English abstract.

International Search Report for PCT/JP2019/023332 dated Sep. 10, 2019.

Extended European search report issued in the counterpart European Patent Application No. 19820045.3, dated Feb. 23, 2022.

Extended European Search Report issued in the counterpart European Patent Application No. 19819511.7, dated Feb. 9, 2022.

U.S. office action issued in the counterpart U.S. Appl. No. 17/251,340 dated Feb. 1, 2022.

U.S. final office action issued in the counterpart U.S. Appl. No. 17/251,340 dated Jun. 24, 2022.

U.S. final office action issued in the counterpart U.S. Appl. No. 17/251,340 dated Mar. 9, 2023.

Office Action issued in the counterpart Japanese Patent Application No. 2020-525628, dated Oct. 31, 2023.

* cited by examiner

MULTILAYERED CONTAINER AND INNER CONTAINER

TECHNICAL FIELD

The present invention relates to a multilayered container having a vertically foldable inner container, and the vertically foldable inner container.

BACKGROUND ART

In recent years, various two-layered or double containers have been proposed to protect content thereof from oxidation and light, and to maintain the freshness of the content. For example, Patent Document 1 proposes a two-layered container which contains a plurality of solids in a closely filled state, by depressurizing and shrinking an inner package in order to avoid damage caused by collision among the plurality of solids, when distributing solid medicine tablets or medicine capsules prior to use.

PRIOR ART DOCUMENT

Patent Document

Patent Document 1: Japanese Laid-Open Patent Publication No. 2010-126215

Non-Patent Document

Non-Patent Document 1: Ichiro Hagiwara et al., "Optimization for Crush Characteristics of Cylindrical Origami Structure Using Reversed Spiral Model", Papers by the Japan Society of Mechanical Engineers (Edition A), Vol. 70, No. 689, January 2004, pp. 36-42

Non-Patent Document 2: Ichiro Hagiwara et al., "Consideration on Crush Characteristics of Cylindrical Structures using Origami Engineering", Society of Automotive Engineers of Japan, Inc., Vol. 34, No. 4, October 2003, pp. 145-149

DISCLOSURE OF THE INVENTION

Problems to be Solved by the Invention

However, in Patent Document 1, although the inner package is shrunk for the distribution, once opened, the inner package is released from the shrunk state and restored such that a space is generated inside, and thus, no consideration is given with regard to shrinking during use.

Accordingly, in view of the above described circumstances, one object of the present invention is to provide a multilayered container capable of continuously protecting content thereof from exposure to the air, and maintaining the quality of the content to the end, by shrinking an inner container so as to reduce the volume thereof according to a remaining volume of the content.

Means for Solving the Problems

One aspect of the present invention provides a multilayered container including an inner container configured to contain content; and an outer container configured to accommodate the inner container, wherein the inner container has a side surface formed with a plurality of folded pleats contractable and expandable in a vertical direction, so that the inner container is shrinkable inside the outer container, wherein the inner container includes a metal layer or an inorganic layer, and wherein a discharge mechanism, configured to discharge the content, and including a mechanism configured to prevent air from entering the inner container when discharging the content, is attached to an upper surface of the inner container.

Effects of the Invention

According to one aspect, in a multilayered container, it is possible to continuously protect the content thereof from exposure to the air, and maintain the quality of the content to the end, by shrinking an inner container so as to reduce the volume thereof according to a remaining volume of the content.

MODE OF CARRYING OUT THE INVENTION

Figure 1:
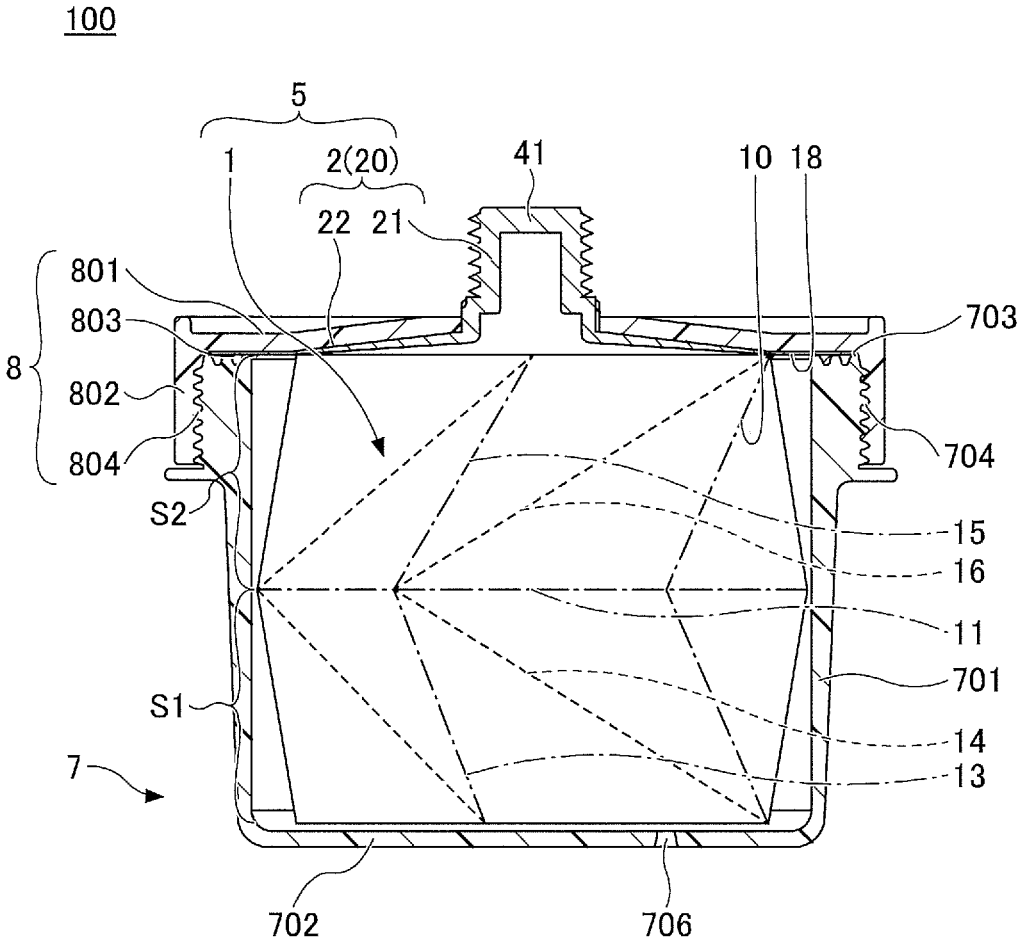
FIG. 1 is a general view of a two-layered container having an inner container according to a first configuration example of the present invention.

Hereinafter, embodiments according to the present invention will be described with reference to the drawings. In each of the following drawings, the same elements are designated by the same reference numerals, and a description of the same elements may be omitted.

<First Configuration Example>

FIG. 1 is a general view illustrating a two-layered container having an inner container according to a first configuration example of the present invention.

A two-layered container 100 includes an inner container 5, and an outer container 7. In this embodiment, the inner container 5 includes a container body 1, and a lid part 20. The container body 1 is made of a flexible material that can shrink when depressurized, and the outer container 7 is made of a material, having fastness and shape retention properties, that can provide protection from external shock. Because the lid part 20 is used for fitting, the lid part 20 is made of a material having shape retention properties to such an extent that is able to retain the shape thereof.

In addition, discharge mechanisms, having various types of airless characteristics, may be attached to an upper portion of the two-layered container 100 according to the present invention. The airless discharge mechanism is a mechanism that discharges a liquid (fluid) content by applying a pressure to the content itself without using air. The discharge mechanism having the airless characteristic according to the present invention includes a mechanism that prevents air from entering the inner container 5 when discharging the content.

Further, the two-layered container 100 may include an upper fixing part 8. The upper fixing part 8 is made of a material, having fastness and shape retention properties, that can provide protection from external shock, as is the outer container 7.

Figure 6:
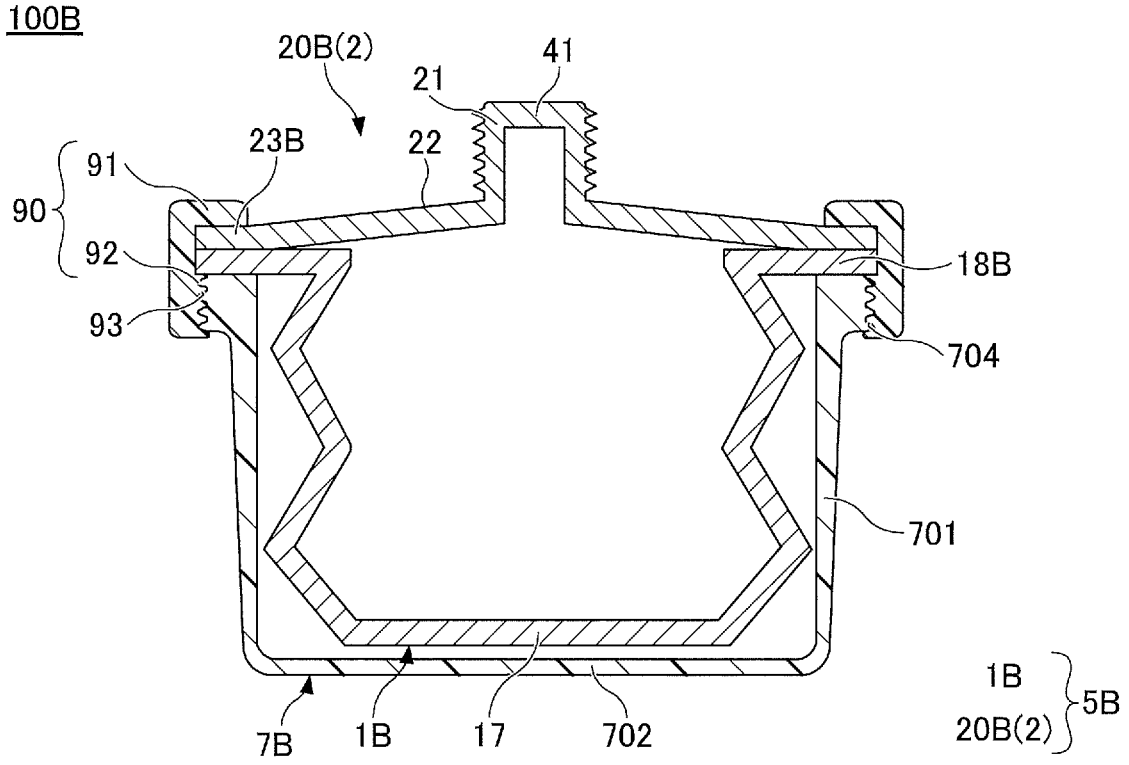
FIG. 6 is a cross sectional view of a first fitting example of the two-layered container according to the present invention.

The container body 1 is a container that contains content or contents, and has a side surface 10 and a bottom surface (lower surface) 17 (refer to FIG. 6). In addition, a flange 18 is provided at an upper end of the side surface 10 of the container body 1, and this flange 18 has a generally annular shape that is formed to extend outwardly in a horizontal direction, or a polygonal inner shape and a ring-shaped outer shape.

Further, a mouth-side member 2, provided above the container body 1, is a lid part 20 (FIG. 1) or 20B (refer to FIG. 6) according to this embodiment. The mouth-side member 2 includes a mouth part 21, a shoulder part 22, and a closing film 41 that closes the mouth part 21. The mouth part 21 stands upwardly from the shoulder part 22, as illustrated in FIG. 1. The lid part 20 includes a metal layer. In the example illustrated in FIG. 1, the closing film 41, which is a metal film integral with the mouth part 21, is provided on the lid part 20. However, the closing film 41, which is separate from the lid part 20, may be attached to the mouth part 21.

In this embodiment, the lid part 20, which is the mouth-side member 2, functions as a constituent element of the inner container 5 that is attached to the container body 1 prior to being accommodated in and attached to the outer container 7.

The outer container 7 has a bottle-like shape including a side surface 701 and a bottom surface 702, so as to accommodate the inner container 5. Moreover, a fitting protrusion 703, which is a threaded convex portion, is provided on an upper end surface of the side surface 701 of the outer container 7. Further, a fitting protrusion 704, which is a threaded convex portion, is provided on an outer portion of the side surface 701 near the upper end surface of the side surface 701. Although FIG. 1 illustrates an example in which the threaded convex portions are provided, the threaded convex portions may be omitted.

The upper fixing part 8 illustrated in FIG. 1 is an example of a fixing part that fixes the lid part 20 with respect to the outer container 7. The upper fixing part 8 includes a top plate 801 that covers the shoulder part 22, other than the mouth part 21 of the lid part 20, from above, and a lid peripheral wall (rim) 802 extends downward from a peripheral edge of the top plate 801. In addition, a fitting groove 803, which is a threaded recess, is formed near the peripheral edge of the top plate 801, and a fitting groove 804, which is a threaded recess, is formed in an inner periphery of the lid peripheral wall 802.

The two-layered container 100 is assembled by fitting the fitting protrusions 703 and 704 on the upper end and the outer periphery of the side surface 701 of the outer container 7, into the fitting grooves 803 and 804 in the top plate 801 and the lid peripheral wall 802 of the upper fixing part 8.

A state illustrated in FIG. 1 in which the outer container 7, the upper fixing part 8, the lid part 20, and the container body 1 are fitted together, will be referred to as a first fitting example.

The two-layered container 100 is configured as an airless container to which a so-called airless discharge mechanism is fitted. For example, the container body 1 (inner bag) of the inner container 5 may be formed of a flexible material that is detachably attached with respect to the outer container 7, and a liquid material may be contained inside the container body 1. In addition, a pumping part (for example, discharge mechanisms 50, 60, and 60F illustrated in FIG. 7, FIG. 8, and FIG. 10 having the airless characteristic) may be configured to pump in the liquid material from a suction port, by an action thereof, while causing decompression and deformation of the container body 1 that is the inner bag, and to supply air between the inner container 5 and the outer container 7 through an external air inlet port 706 formed in the outer container 7.

The configuration of the container body 1 of the inner container 5 will be described below. A plurality of units, that are extendable and retractable in a predetermined direction, are formed on the side surface 10 of the container body. FIG. 1 illustrates an example in which two units (stages) S1 and S2 are formed.

At the side surface 10, a bottom side of a parallelogram and a top side of a parallelogram are shared between the stages (units) that are vertically adjacent, and the shared bottom and top sides in the vertically adjacent stages are regarded as an axis of symmetry, so that the parallelograms are alternately stacked in line symmetry. For example, in the example of FIG. 1, a unit S1 is parallelogram with leftwardly ascending sides, and a unit S2 is a parallelogram with rightwardly ascending sides, so that the vertically adjacent units S1 and S2 are vertically symmetrical.

FIG. 1 illustrates an example in which the two-stage units S1 and S2 are stacked in a vertical direction on the side surface 10, however, as long as the vertically adjacent units are vertically symmetrical, the number of stages of the vertically stacked units forming the side surface may be an arbitrary number, such as three stages, four or more stages, or the like.

Further, FIG. 1 illustrates an example in which the lowermost stage is formed by the unit S1 that is the parallelogram with the leftwardly ascending sides, however, the lowermost stage may be formed by the parallelogram with the rightwardly ascending sides. Similarly, although the uppermost stage is formed by the unit S2 that is the parallelogram with the rightwardly ascending sides in this example, whether the uppermost stage is to be formed by the parallelogram with the leftwardly ascending sides or the rightwardly ascending sides, may be suitably set according to the number stages of the units, so that the vertically adjacent units become vertically symmetrical.

In addition, each of the bottom side of the parallelogram forming a lower end portion of the side surface 10, and the top side of the parallelogram forming an upper end portion of the side surface 10, forming a folded pleat 11 that is the line of symmetry formed by the shared bottom and top sides, is a mountain-fold crease (ridge line).

The unit S1 in the lower stage of FIG. 1 has a mountain-fold crease formed by each side 13 of the parallelogram, and a valley-fold crease formed by a diagonal line 14 of the parallelogram. Similarly, the unit S2 in the upper stage has a mountain-fold crease formed by each side 15 of the parallelogram, and a valley-fold crease formed by a diagonal line 16 of the parallelogram.

The diagonal line 14 of the unit S1 and the diagonal line 16 of the unit S2 are diagonal lines that bisect acute angles of the parallelograms.

In addition, in each of the units S1 and S2 on the side surface 10, the sides of the parallelograms are successively connected in an articulated manner, so that a polygonal shape is observed in a top view. In other words, the container body 1 has a hollow shape having a generally polygonal cross section. In FIG. 1, as an example of the polygon, six parallelograms are provided in each stage, and each stage has a hexagonal shape in the cross sectional view, however, the polygon may have an arbitrary number of sides. As the number of sides of the polygon increases, the shape becomes closer to a circle and a volume thereof increases, but because mass production (manufacturing) processes become difficult, the number of sides is preferably set depending on the application, as appropriate.

The bottom surface 17 of the container body 1 has a polygonal shape corresponding to the number and position of the lower sides of the lowermost stage (S1). For example, the bottom surface is hexagonal. The shoulder part 22 of the lid part 20, in the top view, has a polygonal shape in correspondence with the number and position of the top sides of the uppermost stage (S2). FIG. 1 illustrates an example in which the shoulder part 22 has a hexagonal shape.

The shape of the side surface 10 is called a Reversed Spiral Cylindrical Model (RSC) origami structure (for example, Non-Patent Document 1 and Non-Patent Document 2).

According to this shape, the side surface 10 of the container body 10 becomes folded pleats including the mountain-fold creases 11, 13, and 15 protruding outward, and the valley-fold creases 14 and 16 protruding inward, and can contract and expand in a predetermined direction (vertical direction in FIG. 1). In this embodiment, because the side surface 10 of the container body 1 is vertically symmetrical for each of the stages, it is possible to crush, that is, vertically crush the side surface 10 without changing the positions of the upper and lower ends (without twisting) thereof as the inner container 5 shrinks.

In addition, the bottom surface 17 and the side surfaces 10 forming the container body 1 preferably include a metal layer or an inorganic layer. The metal of the metal layer may preferably be one of aluminum, iron, gold, silver, titanium, tin, zinc, platinum, ruthenium, palladium, and iridium, an alloy (tin plate), or a metal oxide (aluminum oxide (alumina) or the like). To "include a metal layer" may encompass cases where the entire surface is formed by a metal material, or a metal film is formed on a surface of another material (for example, a resin or the like) or is deposited on an inner surface. The inorganic layer includes an inorganic material such as a silica gel (silicon oxide) or the like.

The metal layer and the inorganic layer forming the container body 1 are also air blocking materials. In addition, the metal layer is a light blocking material. The inorganic layer may be colored to have light blocking properties, or may be transparent so as not to have the light blocking properties.

In this configuration, because the container body 1 includes the metal layer or the inorganic layer, and the metal layer is included in the lid part 20 and the closing film 41 that closes the mouth part 21, the content contained in the two-layered container 100 is surrounded by an air barrier layer in all directions, and it is possible to ensure the air blocking properties of the two-layered container 100.

Further, by forming the container body 1 by the metal layer, or by faulting the container body 1 by the transparent inorganic layer and forming the outer container 7 to include an opaque resin, it is possible to ensure the light blocking properties of the two-layered container.

For example, in this embodiment, the metal layer may be formed by metal deposition of aluminum or the like on a plastic sheet, for example, in order to make the container body 1, which is the inner bag of the inner container 5, flexible while maintaining the air blocking properties and the light blocking properties. The metal that is deposited is not limited to aluminum, and may preferably be one of iron, gold, silver, titanium, tin, zinc, platinum, ruthenium, palladium, iridium, or the like, an alloy (tin plate), or a metal oxide (aluminum oxide (alumina), or the like).

Alternatively, in the present invention, the inorganic layer (inorganic deposition layer) of the container, which is the inner container, may be formed by depositing an inorganic material on a plastic sheet, for example, in order to provide flexibility. The inorganic material may be silica gel (silicon oxide) or the like, for example.

The container body 1 may contain content including oxygen and/or light sensitive materials. Examples of the content is not particularly limited, and may include vitamins (vitamins A, C, or the like) and derivatives thereof or the like, cosmetics, pharmaceuticals, foods, or the like including ingredients that are easily oxidized or easily deteriorated.

The outer container 7 is formed to include a plastic or a resin, such as polyethylene (PE), polypropylene (PP), polyethylene terephthalate (PET), or the like, for example, so as to withstand external shock.

Figure 7:
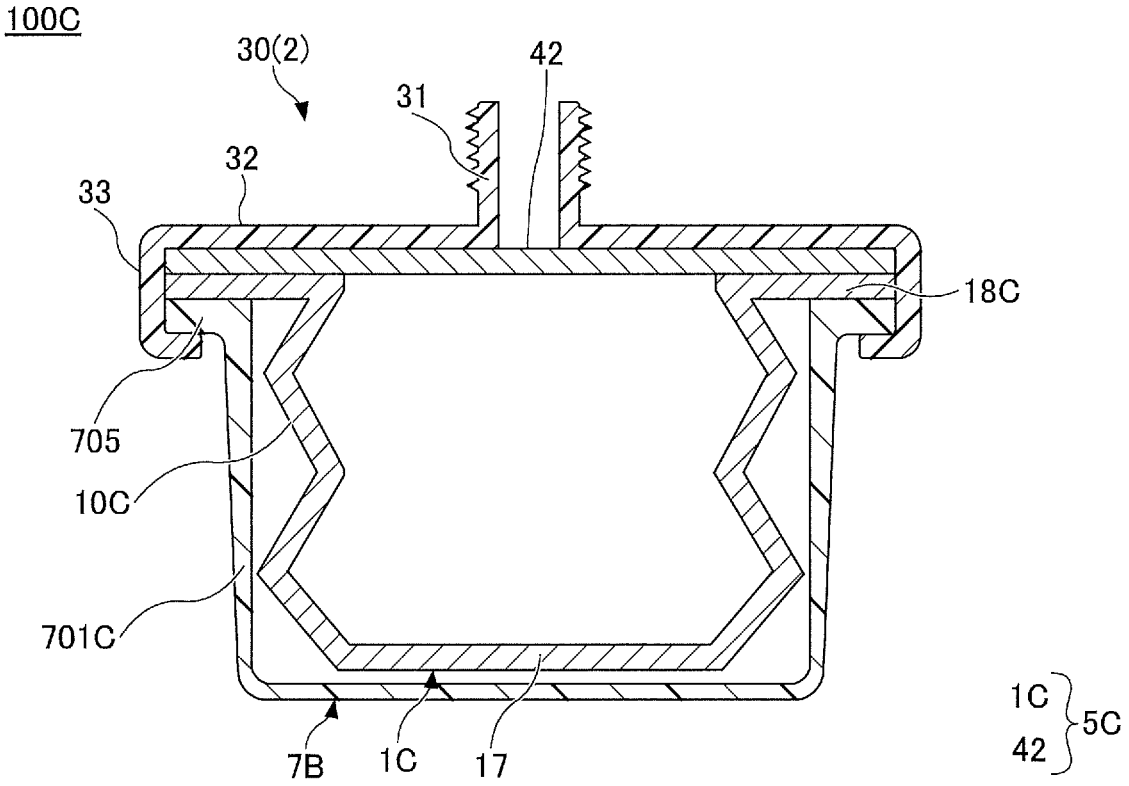
FIG. 7 is a cross sectional view of a second fitting example of the two-layered container according to the present invention.

The configuration example in which members of the two-layered container are assembled is not limited to the example of FIG. 1, and the configuration may be as illustrated in FIG. 6 and FIG. 7.

<Second Configuration Example>

Figure 2:
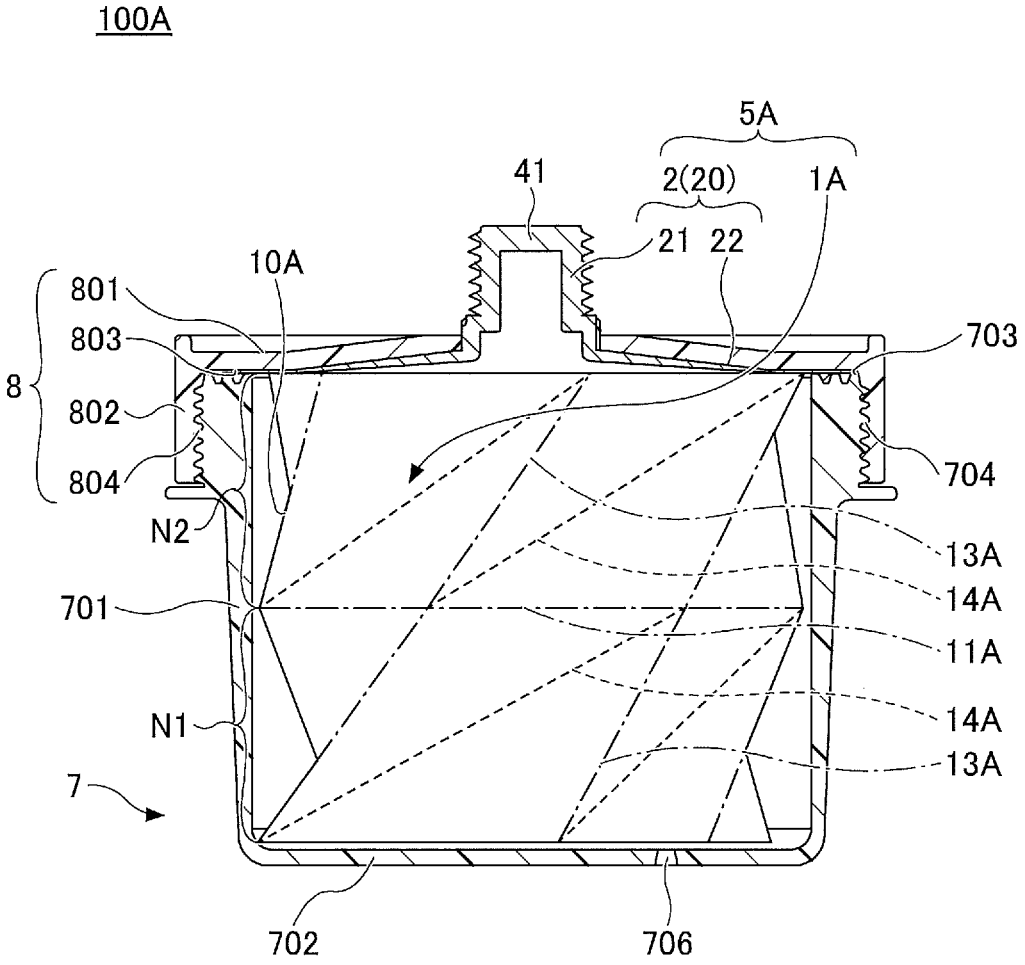
FIG. 2 is a general view of the two-layered container having the inner container according to a second configuration example of the present invention.

FIG. 2 is a schematic diagram illustrating a two-layered container having an inner container according to a second configuration example of the present invention. In this embodiment, the shape of a side surface 10A of a container body 1A in an inner container 5A is different from that of FIG. 1, but the shape of other members such as the lid part 20, the outer container 7, and the upper fixing part 8 are similar to those of FIG. 1.

At the side surface 10A of the container body 1A in FIG. 2, approximately the same units (stages) (N1, N2) are repeated in the vertical direction. In other words, the side surface 10A has a corrugated shape in which the top side and a bottom side 11A of the parallelograms are shared between the vertically adjacent stages, and the parallelograms are stacked while being slightly shifted vertically.

More specifically, in this embodiment, a mountain-fold crease formed by each side 13A of the parallelogram, and a valley-fold crease formed by a diagonal line 14A of the parallelogram, are famed in each unit, and each of stages N1 and N2 are stacked by sharing the top side and the bottom side of the parallelograms in the vertically adjacent stages (units).

In addition, although FIG. 2 illustrates an example in which the parallelograms with the rightwardly ascending sides are formed in succession, the parallelograms with the leftwardly ascending sides may be formed in succession.

According to the configuration of this embodiment, because the units N1 and N2, including folded pleats that can contract and expand in a predetermined direction, are also formed on the side surface 10A of the container body 1A, the side surfaces 10A can contract and expand inside the outer container 7. In this configuration, the parallelograms in each of the stages share the top side and the four sides, and the positions the parallelograms are slightly shifted for each of the stages N1 and N2 to form the side surface 10A, the container body 1A shrinks while being twisted when the side surface 10A contracts.

The container bodies 1 and 1A of FIG. 1 and FIG. 2 illustrate examples in which the two units S1 and S2 and the two stages N1 and N2 are provided, however, the units or stages forming the side surfaces 10 and 10A may be three or more units or stages.

<Third Configuration Example>

Figure 3:
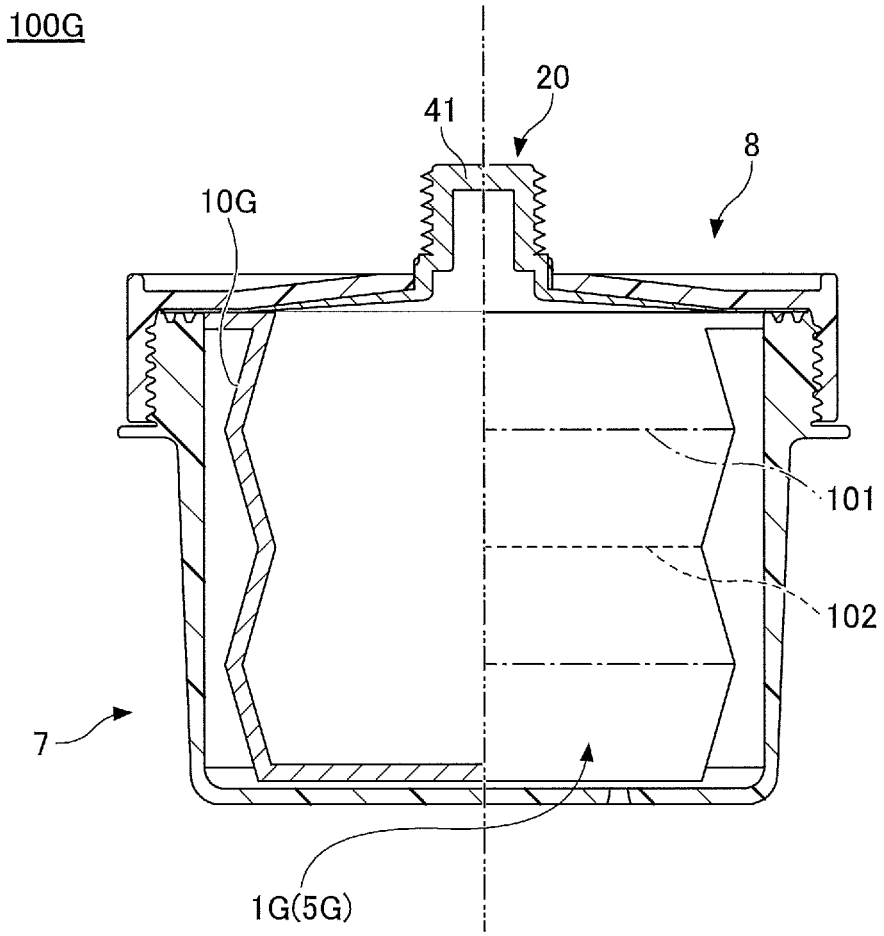
FIG. 3 is a general view of the two-layered container having the inner container according to a third configuration example of the present invention.

FIG. 3 is a schematic diagram illustrating a two-layered container 100G having an inner container of a third configuration example of the present invention. In this embodiment, the shape of a side surface 10G of a container body 1G in an inner container 5G is different from that in FIG. 1, but the shape of other members such as the lid member 20, the outer container 7, and the upper fixing part 8 are similar to those of FIG. 1.

In this configuration, the side surface of the container body 1G has a bellows shape. A horizontally extending mountain-fold crease 101, and a valley-fold crease 102 are alternately provided in the vertical direction on the side surface 10G of the container body 1G.

<Shrinking of Container Body in First Configuration Example>

Figure 4:
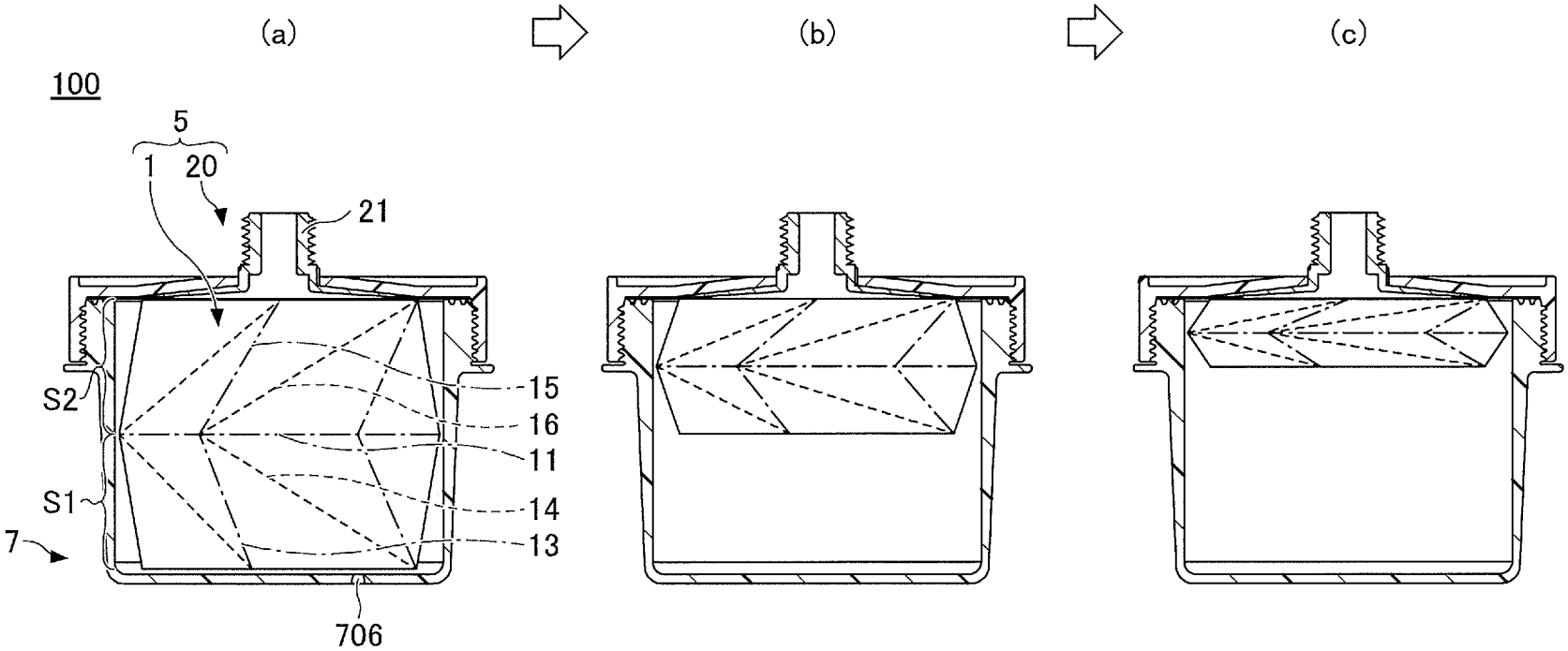
FIG. 4 is a diagram illustrating shrinking of a container body in the two-layered container of FIG. 1 according to the present invention.

FIG. 4 is a diagram illustrating the shrinking of the container body included in the two-layered container of FIG. 1. In FIG. 4, (a) illustrates a state of an unopened two-layered container, (b) illustrates a state of the two-layered container after the amount of the content decreases, and (c) illustrates a state of the two-layered container after being emptied of the content thereof.

A check valve is provided in a cap 54 (refer to FIG. 7) of an airless pump 50 that is a dispenser type discharge mechanism, and pump heads 60 and 60F (refer to FIG. 8 and FIG. 10), which are attached to the mouth part 21 of the lid part 20, so as to prevent the air from coming into contact with the inside of the container body. When the amount of the content in the container body 1 of the inner container 5 becomes small, the mountain-fold creases 11, 13, and 15 protrude outward, and the valley-fold creases 12, 14, and 16 fold inward and collapse, to become folded. In this state, because the check valve prevents air from entering the inner container 5, and the pressure inside the inner container 5 is lower than the atmospheric pressure, the inner container 5 remains in the state shrunk in the vertical direction.

The cap 54 of the airless pump 50 (refer to FIG. 7), and the pump heads 60 and 60F (refer to FIG. 8 and FIG. 10), attached to the mouth part 21, are configured to prevent the air from entering the container body 1 during use.

On the other hand, the external air inlet port 706, formed in the bottom surface 702 of the outer container 7, maintains the pressure on the immediate inner side of the outer container 7 at the atmospheric pressure.

According to these configurations, as the amount of the content of the container body 1 decreases, it is possible to automatically shrink the container body 1 in the upward direction by air pressure, that is, by a pressure difference between the outer side of the container body 1 and the inner side of the outer container 7, as illustrated by (a)-(b) (c) in FIG. 3, and maintain the shrunk state.

Further, as illustrated in FIG. 4, when the container body 1 included inside the two-layered container 100 of the present invention is folded along fold lines (folded pleats) as in origami, a repulsive force, that urges to return to the state before being folded, does not act, unlike the bellows shape. For this reason, the container body 1 can be folded to reduce the volume while maintaining the air blocking properties.

Accordingly, by shrinking the container body 1 of the inner container so as to reduce the volume according to the remaining amount of the content, the two-layered container 100 having the two-layer structure, which is a multilayered container of the present invention, can continue to protect the content from exposure to the air, and maintain the quality of the content until the end.

As illustrated in FIG. 4(*a*) through FIG. 4(*c*), because S1 and S3 of the first stage and S2 and S4 of the second stage are provided in line symmetry along the vertical direction in the container body 1 of the two-layer container of this embodiment, the side surface 10 folds in vertical symmetry when the container body 10 shrinks, and the upper end of the side surface 10 moves immediately below without rotating the upper end and the lower end of the side surface 10. In other words, the container body 1 of FIG. 1 is crushed in the vertical direction.

Furthermore, although the container body 1 is formed of a material that includes a metal layer and is configured to vertically overlap a convex surface and a concave surface in stages, the side surface 10 of the container body of the present invention exhibits the same pattern in every other stage, and thus, when a mold is made for every two stages, the mold does not need to be displaced during the manufacturing process, and the manufacturing process can be simplified.

The container body 1G, which is the inner container having the bellows shape illustrated in FIG. 3, is vertically crushed along the folded pleats in the vertical direction, similar to FIG. 4.

<Shrinking in Second Configuration Example>

Figure 5:
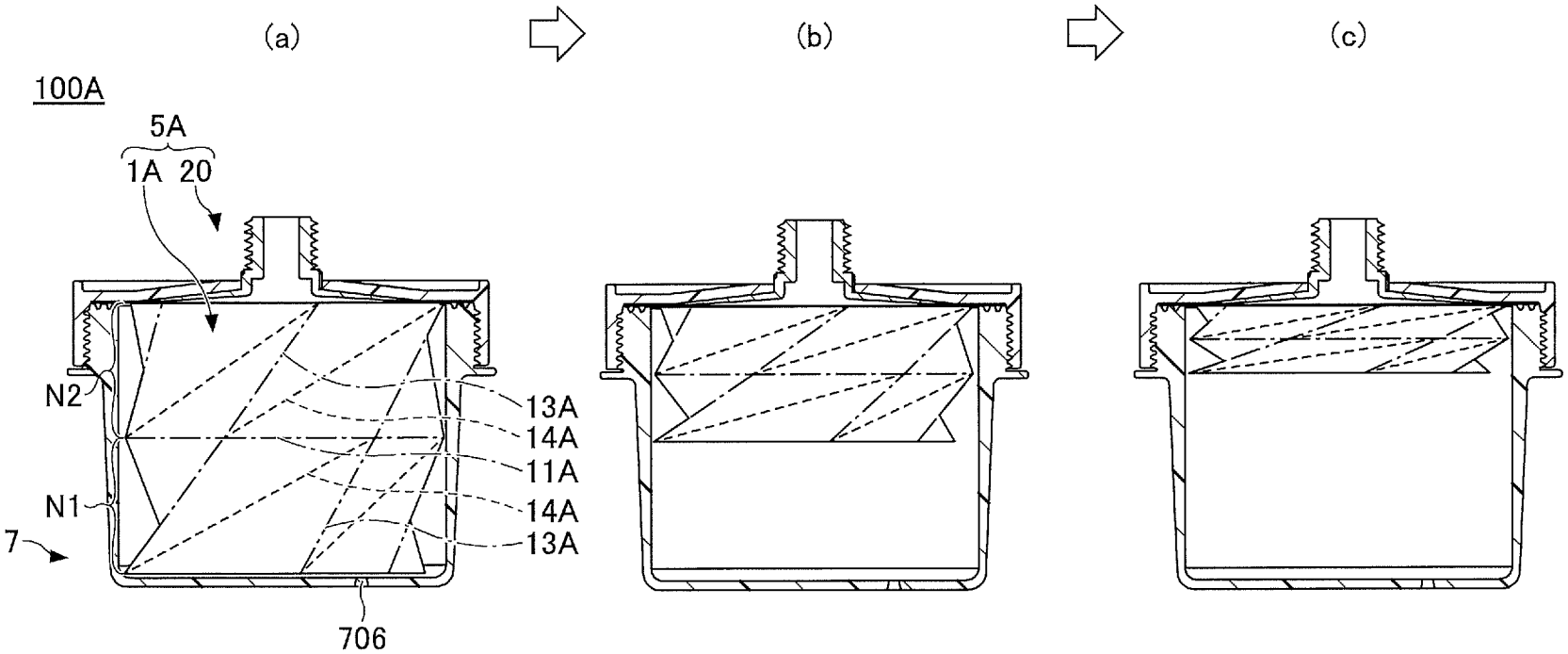
FIG. 5 is a diagram illustrating the shrinking of the container body in the two-layered container of FIG. 2 according the present invention.

FIG. 5 is a diagram illustrating the shrinking of the container body 1A included in the two-layered container 100A of FIG. 2. In FIG. 5, (a) illustrates a state of an unopened two-layered container, (b) illustrates a state of the two-layered container after the amount of the content decreases, and (c) illustrates a state of the two-layered container after being emptied of the content thereof.

In this embodiment, a check valve is also provided in the cap 54 (refer to FIG. 7) of the airless pump 50, and the pump heads 60 and 60F (refer to FIG. 8 and FIG. 10), which are attached to the mouth part 21 of the lid part 20, so as to prevent the air from coming into contact with the inside of the container body. When the amount of the content in the container body 1A of the two-layered container 100A becomes small, the mountain-fold creases 11A and 13A protrude outward, and the valley-fold creases 12A and 14A fold inward and collapse, to become folded.

In this embodiment, similar to the first embodiment, as the amount of the content of the container body 1A decreases, it is possible to automatically shrink the container body 1A in the upward direction by the pressure difference between the outer side of the container body 1A and the inner side of the outer container 7, as illustrated by (a) (b) (c) in FIG. 5, and maintain the shrunk state.

As illustrated in FIG. 4, in this embodiment, when the inner container of the second configuration example of the present invention is folded along fold lines that are folded pleats as in origami, a repulsive force, that urges to return to the state before being folded, does not act, similar to FIG. 4. For this reason, the container body 1A can be folded to reduce the volume while maintaining the air blocking properties.

Accordingly, in this embodiment, by shrinking the container body of the inner container 5A so as to reduce the volume according to the remaining volume of the content, the two-layered container 100A, which is the multilayered container, can continue to protect the content from exposure to the air, and maintain the quality of the content until the end.

Further, as illustrated in FIG. 5(*a*) through FIG. 5(*c*), in the container body 1A according to this embodiment, the positions where the parallelograms are arranged on the side surface 10A are shifted for each of the stages N1 and N2, so that the side surface 10A is folded while rotating and twisting the upper end and the lower end of the side surface 10A when shrinking the container body 1A.

In addition, the metal layer included in the side surface 10 (10A) of the container bodies 1 and 1A can undergo plastic deformation so as to reduce the volume, because portions of the folded pleats provided in advance are deformed when shrinking the container bodies 1 and 1A. For this reason, as illustrated in FIG. 4(*c*) and FIG. 5(*c*), even if the inner container 5 (5A) is removed from the outer container 7, when replacing the inner container 5 (5A) or disassembling and disposing the outer container 7 and the inner container 5 (5A) after the content is used up and the inner container 5 (5A) is shrunk, the container body 1 (1A) can maintain the shrunk state due to the plastic deformation along the folded pleats, and thus, a user does not need to crush the inner container 5 (5A) after use.

Moreover, when the container body 1 (1A, 1G) is crushed, a force is unlikely applied to the portions other than the prescribed fold creases, and scratches, dents, and cracks are unlikely formed on the side surface 10 (10A, 10G), and the appearance of the container body 1 (1A, 1G) is good because a plurality of container bodies 1 (1A, 1G) can be crushed along the fold creases to similar external appearances. Further, because the plurality of container bodies 1 (1A, 1G) can be crushed to the similar external appearances, a recycling process that collects and reuses the container bodies 1 (1A, 1G) is facilitated because the fold creases simply need to be expanded after cleaning.

In addition, as illustrated in FIG. 4 and FIG. 5, in the two-layered container of the present invention, the container body on the inner side shrinks, while the outer side remains to stand. For this reason, when a product label or the like is affixed to the side surface of the outer container 7 on the outer side, for example, it is possible to maintain the product label in a visibly recognizable state even at the end of use.

On the other hand, as illustrated in FIG. 4 and FIG. 5, the container bodies 1 and 1A are folded regularly along the folded pleats, and thus, the appearance after being shrunk is good even after being automatically shrunk. For this reason, even if the outer container 7 is made transparent in its entirety or in part so that container bodies are visually recognizable from the outside, the user can enjoy a change in the shape of the container bodies 1 and 1A that fold as the container bodies 1 and 1A shrink, without causing the change to appear unsightly to the user. When a part of the outer container 7 is made transparent, it is preferable to provide a slit that extends in the vertical direction to enable visual confirmation of the shrinking of the container bodies 1 and 1A from the outside.

Alternatively, the outer container 7 may be formed entirely of an opaque material. In this case, because the container body 1 (1A) on the inner side is not visible from the outside, it is possible to employ a design that hides the deformation of the container body 1 (1A).

<Second Fitting Example>

FIG. 6 is an exploded view of a second fitting example of the two-layered container of the present invention. A two-layered container 100B in this embodiment includes a clasp 90 that fixes the side part, in place of the upper fixing part 8.

A flange 18B is provided at an upper end of a side surface 10B of a container body 1B, which is a part of an inner container 5B, and this flange 18B has a generally polygonal annular shape that is formed to extend outwardly in the horizontal direction, or a polygonal inner shape and a ring-shaped outer shape. In addition, a lid part 20B is attached to an upper surface of the flange 18B. The outer container 7B has a side surface 701 and a bottom surface 702.

The clasp 90 is another example of the fixing part that fixes the lid part 20B with respect to the outer container 7B. The clasp 90 is a ring-shaped sealing member with an upper surface 91 and a side surface 92. A fitting groove 93 is formed in an inner periphery of the side surface 92.

The flange 18B and an end 23B of the shoulder part 22 of the lid part 20B are sandwiched between a top surface of the side surface 701 of the outer container 7B and the clasp 90. In other words, the clasp 90 is assembled by sandwiching the end 23 of the shoulder part 22 of the lid part 20 and the flange 18B of the inner container 5B, and fitting the fitting protrusion 704 of the outer container 7 into the fitting groove 93 of the clasp 90, similar to the upper fixing part 8 in FIG. 1.

The lid part 20B has the shoulder part 22, and the mouth part 21 standing upwardly from the shoulder part 22, similar to FIG. 1. The closing film 41, which is integral with the mouth part 21 and thinner than the mouth part, is provided on the lid part 20B to seal the mouth part 21, and the closing film 41 is broken during use or when the discharge mechanisms 50, 60, and 60F having the airless characteristics, to be described later in conjunction with FIG. 8 and subsequent figures, are attached to the mouth part 21.

According to this configuration, because the container body 1B includes a metal or inorganic layer, and the lid part 20B and the closing film 41 covering the mouth part 21 include a metal layer, it is possible to ensure the air blocking properties of the two-layered container 100B.

<Third Fitting Example>

FIG. 7 is an exploded view of a third fitting example of the two-layered container of the present invention. In this embodiment, an inner container 5C, which is detachable with respect to an outer container 7C, is formed by a container body 10. Further, a two-layered container 100C includes an upper pressing part 30 having an engaging function and a mouth part, in place of the lid part 20 or 20B, and does not include the upper fixing part 8 and the retaining portion 90.

A flange 18C is provided at an upper end of a side surface 100 of the container body 10, which is a part of the inner container 5C, and this flange 18C has a generally polygonal annular shape that is formed to extend outwardly in the horizontal direction, or a polygonal inner shape and a ring-shaped outer shape.

Further, in this configuration, a flange 705 is also provided at an upper end of a side surface 701C of the outer container 7C, and this flange 705 has a generally polygonal annular shape that is formed to extend outwardly in the horizontal direction, or a polygonal inner shape and a ring-shaped outer shape.

A metal film 42 is adhered on a lower surface of the upper pressing part 30, and when shipping the container, the content is filled in an oxygen-free atmosphere, and the upper pressing part 30 and the inner container 5C are fitted thereafter to put the inner container 5C into a sealed state. Alternatively, when assembling the container, the metal film 42 is sandwiched between the upper pressing part 30 and the flange 18C, and pressed by the upper pressing part 39, so that the inner container 5C is put into the sealed state.

According to this configuration, because the container body 10 includes a metal layer or an inorganic layer, and the metal film 42 covering the entire upper surface of the container body 1C includes a metal layer, it is possible to ensure the air blocking properties of the two-layered container 100C.

The upper pressing part 30 includes the mouth part 31, the shoulder part 32 forming the upper surface, and a peripheral wall part 33 standing downward from an outer peripheral edge of the shoulder part 32. The shoulder part 32 of the upper pressing part 30 presses against the flange 18C and the metal film 42 from above. The upper pressing part 30 functions as the mouth-side member 2 having the mouth part 31 and the shoulder part 32.

The peripheral wall part 33 of the upper pressing part 30 fits over the flange 18C of the container body 10, the metal film 42, and the flange 705 of the side surface 701C of the outer container 7C, and holds the flange 18C, the metal film 42, and the flange 705 from the outer peripheries thereof.

According to this configuration, because the content included in the two-layered container 100C is surrounded by an air barrier layer in all directions, by the container body 10 and the metal film 42, the upper pressing part 30 need not be formed of a material (metal or the like) having air barrier properties, as long as the material has fastness and shape retention properties that can provide protection from external shock. For example, the upper pressing part 30 may be formed of a plastic or a resin, such as polyethylene (PE), polypropylene (PP), polyethylene terephthalate (PET), or the like, similar to the outer container 7C.

In this embodiment, the upper pressing part 30, which is the mouth-side member 2, is a constituent element of the two-layered container 100C, which is simultaneously attached to the container body 10 and the outer container 7C after the container body 10 is accommodated in the outer container 7C.

Accordingly, by maintaining the metal film 42 adhered until immediately prior to use, it is possible to maintain the oxygen-free state inside the container body 1. The metal film 42 deep inside the mouth part 31 is broken during use, or when the discharge mechanisms 50, 60, and 60F having the airless characteristics, to be described later in conjunction with FIG. 8 and subsequent figures, are attached to the mouth part 21.

The shoulder part 22 of the lid part 20 of FIG. 6 is configured to be higher toward the center, however, the lid member may have a flat shape as in the case of the shoulder part 32 of the upper pressing part 30 of FIG. 7. Conversely, although the shoulder part 32 of the upper pressing part 30 of FIG. 7 has a flat shape, the shoulder part 32 may have a structure that is higher toward the center as in the case of the shoulder part 22 of the lid part 20 of FIG. 6.

In FIG. 6 and FIG. 7, the container body 1 with the side surface having the RSC structure illustrated in FIG. 1 is described as the container body of the inner container, however, the container body 1A with the side surface having the corrugated structure illustrated in FIG. 2, and the container body 1G with the side surface having the bellows-shaped illustrated in FIG. 3, may be applied to the configuration of FIG. 6 and FIG. 7.

In the two-layered containers of FIG. 1, FIG. 2, FIG. 3, FIG. 6, and FIG. 7, the inner containers 5, 5A, 5B, and 5C having the container body 1 (1A, 1B) and the lids 20 and 20B, are preferably detachably attached to the outer container 7. In this case, when the inside of the container body 1 of the inner container 5 (5A, 5B, and 5C) becomes empty, or the liquid material in the container body 1 runs short, this inner container 5 can be replaced with a new inner container 5 filled with liquid material.

In this case, the outer container 7 and the upper fixing part 8/clasp 90/or the upper pressing part 30 may continue to be used. In addition, when the inside of the container body 1 of the inner container 5 becomes empty, or the liquid material in the container body 1 runs short, the inner container 5 may once be removed from the outer container 7 to refill the inner container 5 with the liquid material, and then reattach the refilled inner container 5 to the outer container 7.

Figure 8:
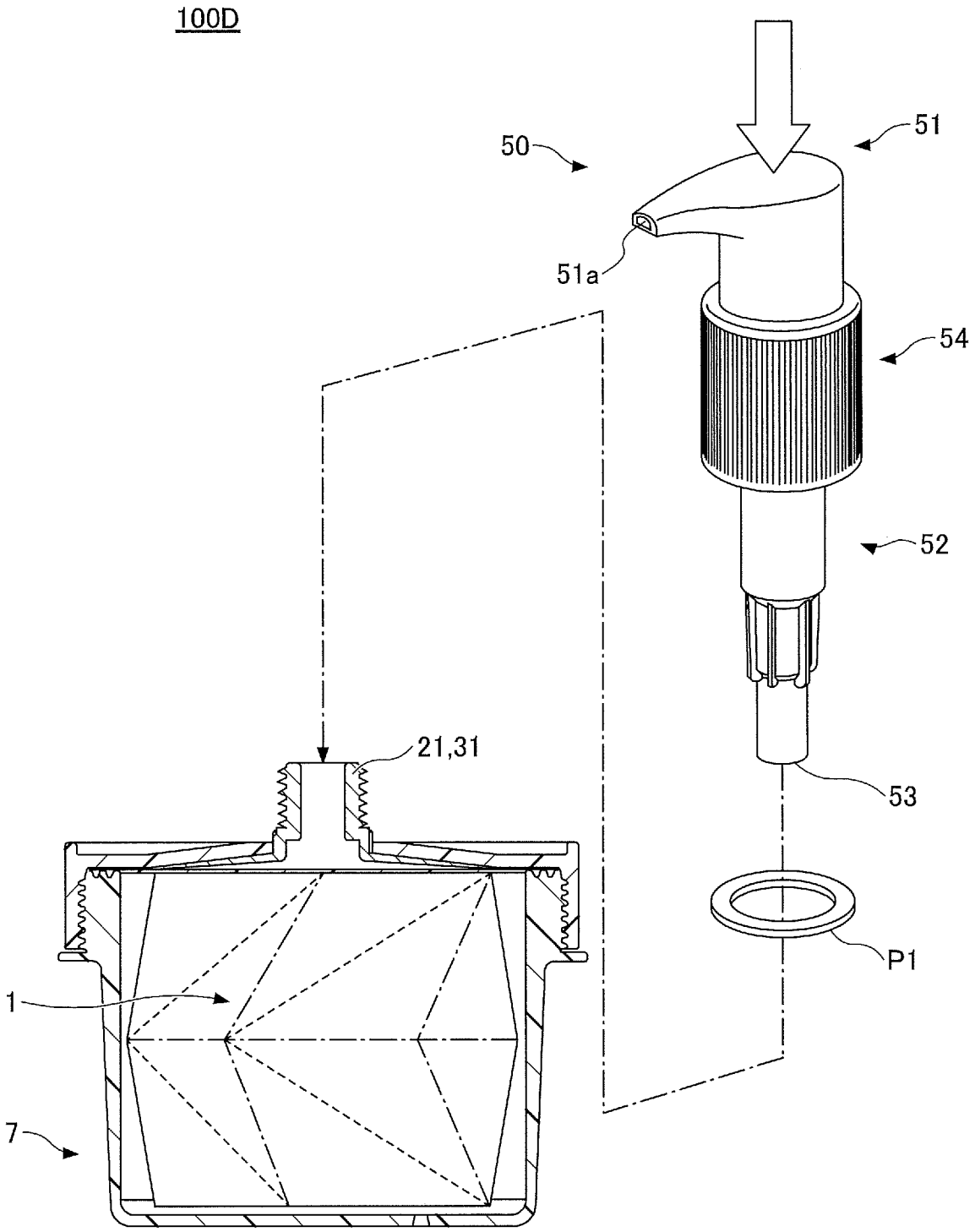
FIG. 8 is a diagram illustrating an example in which an airless pump is attached, as a discharge mechanism, at a mouth part of the two-layered container according to the present invention.
Figure 9:
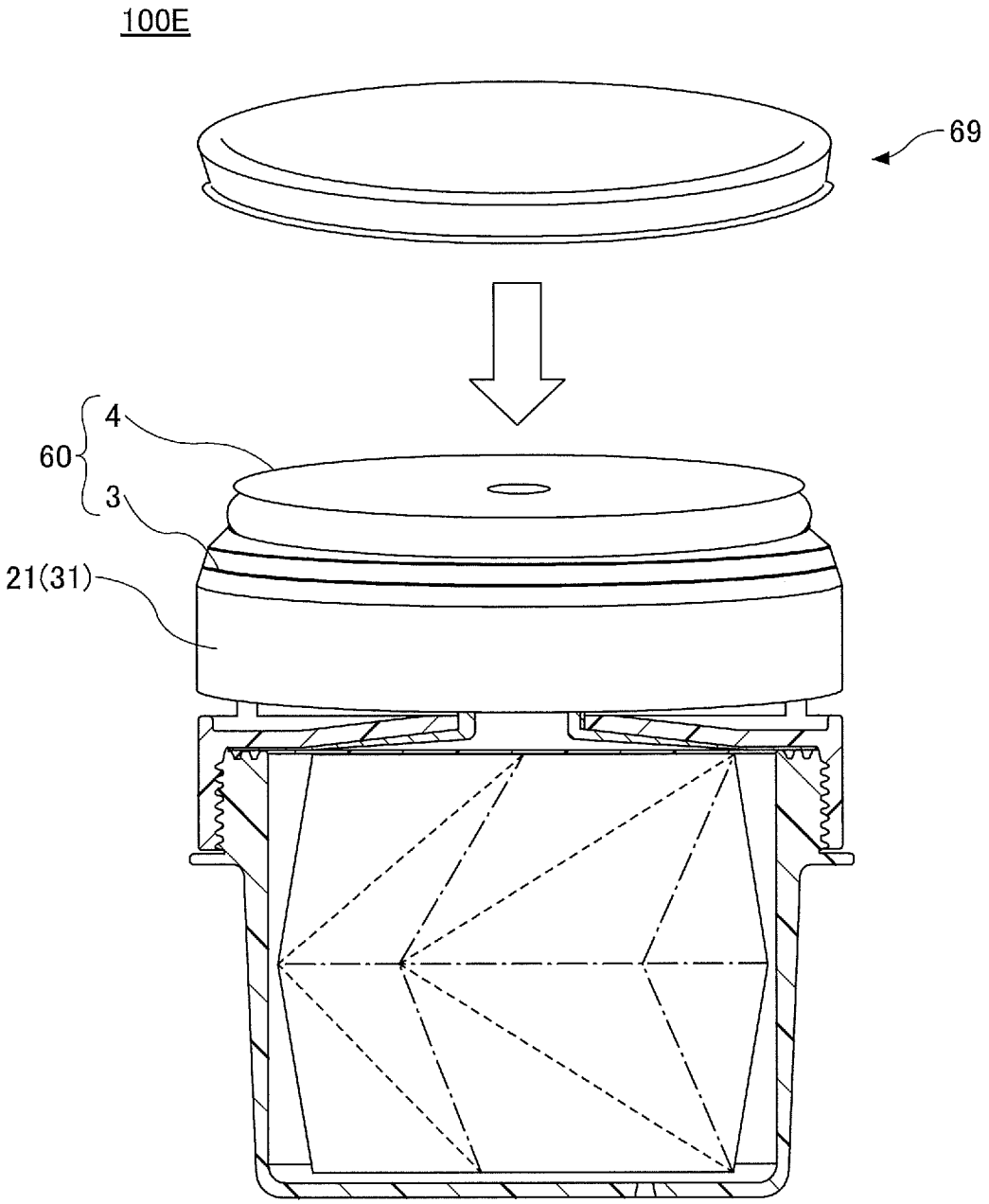
FIG. 9 is a diagram illustrating an example in which a push pump is attached, as the discharge mechanism, at the mouth part of the two-layered container according to the present invention.
Figure 11:
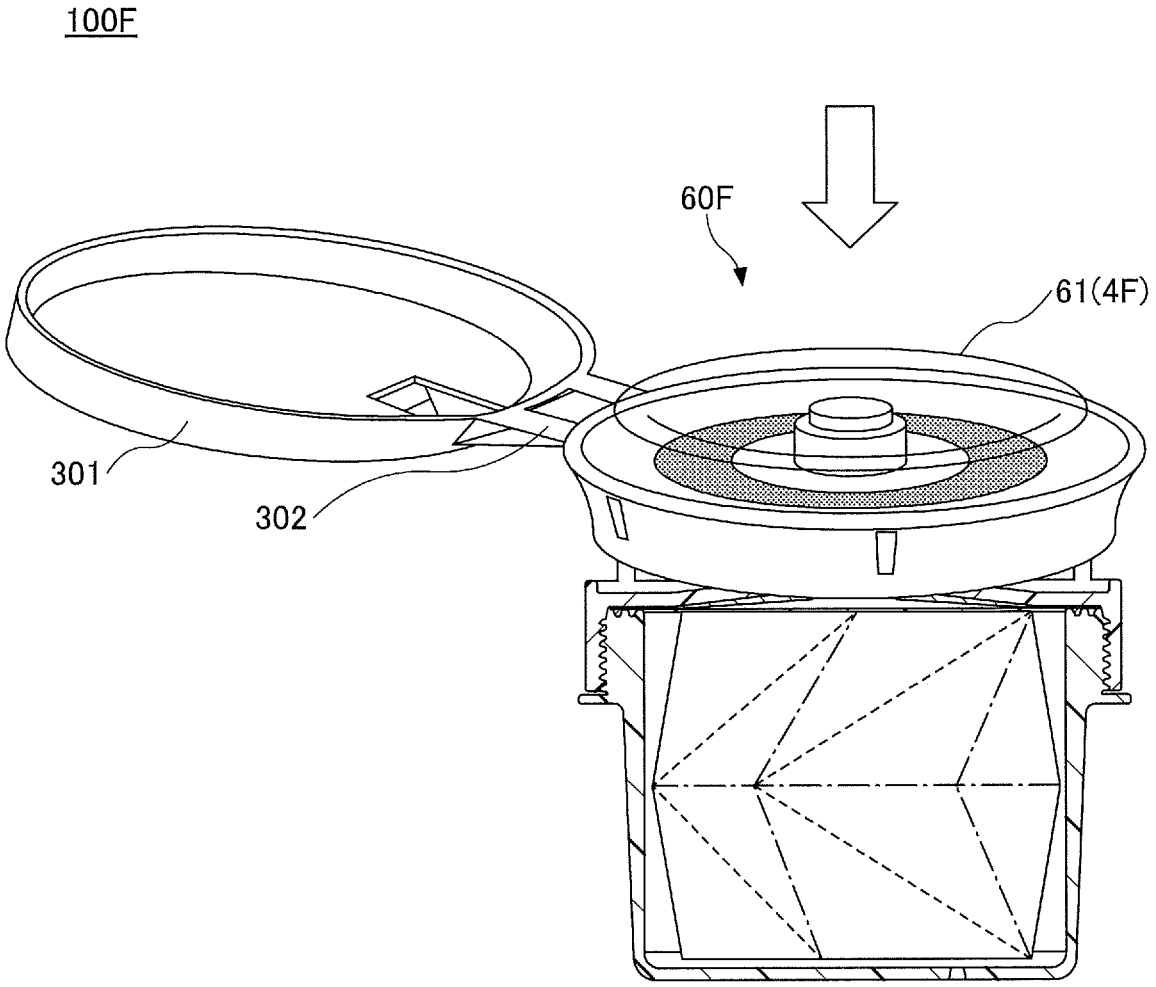
FIG. 11 is a diagram illustrating an example in which a push pump with a tray is attached, as the discharge mechanism, at the mouth part of the two-layered container according to the present invention.

When the discharge mechanisms 50, 60, and 60F having the airless characteristics illustrated in FIG. 8, FIG. 9, and FIG. 11 is attached to the mouth part 21 or 31 of the two-layered containers illustrated in FIG. 1, FIG. 2, FIG. 3, FIG. 6, and FIG. 7, the container body 1 of the inner container 5 shrinks when the remaining amount of the contained content becomes small, but the shape of the outer containers 7, 7A, and 7B does not change. FIG. 8, FIG. 9, and FIG. 11 described below illustrate examples in which the discharge mechanism 50, 60 and 60F are attached to the two-layered container 100 illustrated in FIG. 1, however, the two-layered container to which the discharge mechanism is attached may have the configuration of any of the two-layered containers 100, 100A, 100G, 100B, and 100C.

<Attaching Airless Pump (1: Horizontal Discharge Pump)>

FIG. 8 illustrates an example in which the airless pump 50 is attached to the mouth part 21 of a two-layered container 100D of the present invention. The airless pump 50 illustrated in FIG. 8 is an example of the horizontal discharge type discharge mechanism having the airless characteristics. The shape of the mouth part 21 or 31 of this configuration may be different from the shape illustrated in FIG. 1, and may be in accordance with the fitting shape of the cap 54.

The airless pump 50 illustrated in FIG. 8 includes a neck 51 having a outlet 51*a*, a body 52 connected to the neck 51, a cylindrical suction tube 53 connected to a lower end of the body 52, and the cap 54 provided around a connecting part of the body 52 and the neck 51.

When attaching the airless pump 50 to the mouth part 21 (31), the closing film 41 of FIG. 6 or the metal film 42 of FIG. 7 is pierced and punctured by the suction tube 53. Then, the cap 54 is screwed and fitted on the mouth part 21.

At the airless pump 50, the inlet tube 53 is not in contact with the content prior to assembly. Further, when the neck 51 is pressed, the inside of the container body 1 is drawn, so that the side surface of the container body 1 shrinks due to decompression of the container body 1, and the volume of the container body 1 decreases. As a result, the content is moved to the airless pump 50, and a predetermined amount of the content is discharged to the outside.

In addition, in order to maintain sealing properties, the airless pump 50 may be provided with an annular packing P1, an inlet valve for opening and closing, a discharge valve (not illustrated), or the like.

Accordingly, when attaching the airless pump 50 to the mouth part 21 (31), the air hardly enters the airless pump 50 even after the closing film 41 or the metal film 42 is punctured, and thus, oxygen is prevented from making contact with the content inside the container body 1 as much as possible, and it is possible to maintain a state where the denaturation caused by oxidation is minimized until the content is discharged.

Further, in this configuration, because the container body 1 shrinks according to the remaining amount of the content while maintaining the sealed state, it is possible to confirm the remaining amount of the content at a glance, by checking the shrunk state of the container body 1 from outside the outer container 7 that is transparent in its entirety or in part.

For example, examples of the container, which requires the air barrier properties and accommodates a low-viscosity liquid that is used on multiple occasions, may suitably include fluid packages or the like, such as condiment containers, condiment tubes, travel mini-bottles for cosmetics and sanitary supplies, pouches for retort foods and beverages, or the like, for example.

In addition, according to this configuration, the content can be sprayed by adjusting the diameter size of the outlet 5*a* of the airless pump 50 illustrated in FIG. 7, or the type of a piston provided inside the airless pump 50.

In this configuration, the airless pump 50 may be attached to the mouth part 21 (31) during a pre-shipment manufacturing process, or the airless pump 50 and the two-layered container 100 (100A, 100B, 100C) may be sold separately and assembled by the user.

In a case where at least one of filling the content, assembling the outer container 7 and the mouth-side member with respect to the outer container 1, and attaching the airless pump 50 for the content, is performed in a different room during the pre-shipment manufacturing process, and the airless pump is attached in the oxygen-free state after sealing by the fitting and assembling illustrated in FIG. 6 and FIG. 7, the airless pump is attached in a state where a portion of the closing film 41 or the metal film 42 illustrated in FIG. 6 and FIG. 7 corresponding to at least the mouth part 21(31) is punctured or removed.

Alternatively, in a case where the filling the content, the assembling the outer container 7 and the mouth-side member with respect to the outer container 1, and the attaching the airless pump 50 are performed by a series of processes in the same room in an oxygen-free state during the manufacturing process, the closing film 41 and the metal film 42 illustrated in FIG. 6 and FIG. 7 may be omitted, because the airless pump 50 can seal the entire two-layered container 100.

On the other hand, when the airless pump 50 is manually attached to the mouth part by the user, the container body 1D and the airless pump 50 are filled with an inert gas (nitrogen or the like) to realize the oxygen-free state in the shipping state. Hence, even when the user punctures the metal film 42 by the suction tube 53 immediately prior to use, the air hardly enters inside the container body 1, and thus, oxygen is prevented from making contact with the content inside the container body 1D as much as possible, and it is possible to maintain the state where the denaturation caused by oxidation is minimized until the content is discharged.

<Attaching Second Discharge Mechanism: Airless Pump (2: Pressing Head)>

FIG. 9 illustrates an example in which the pump head 60 is attached to the mouth part 21 (31) of a two-layered container 100E of the present invention.

The pump head 60 is an example of an upwardly discharging type discharge mechanism having the airless characteristics.

In this configuration, the pump head 60 discharges the content upward using a pump similar to the case of FIG. 8. In addition, a cap 69, that covers the entire the pump head 60, may be detachably provided.

Figure 10:
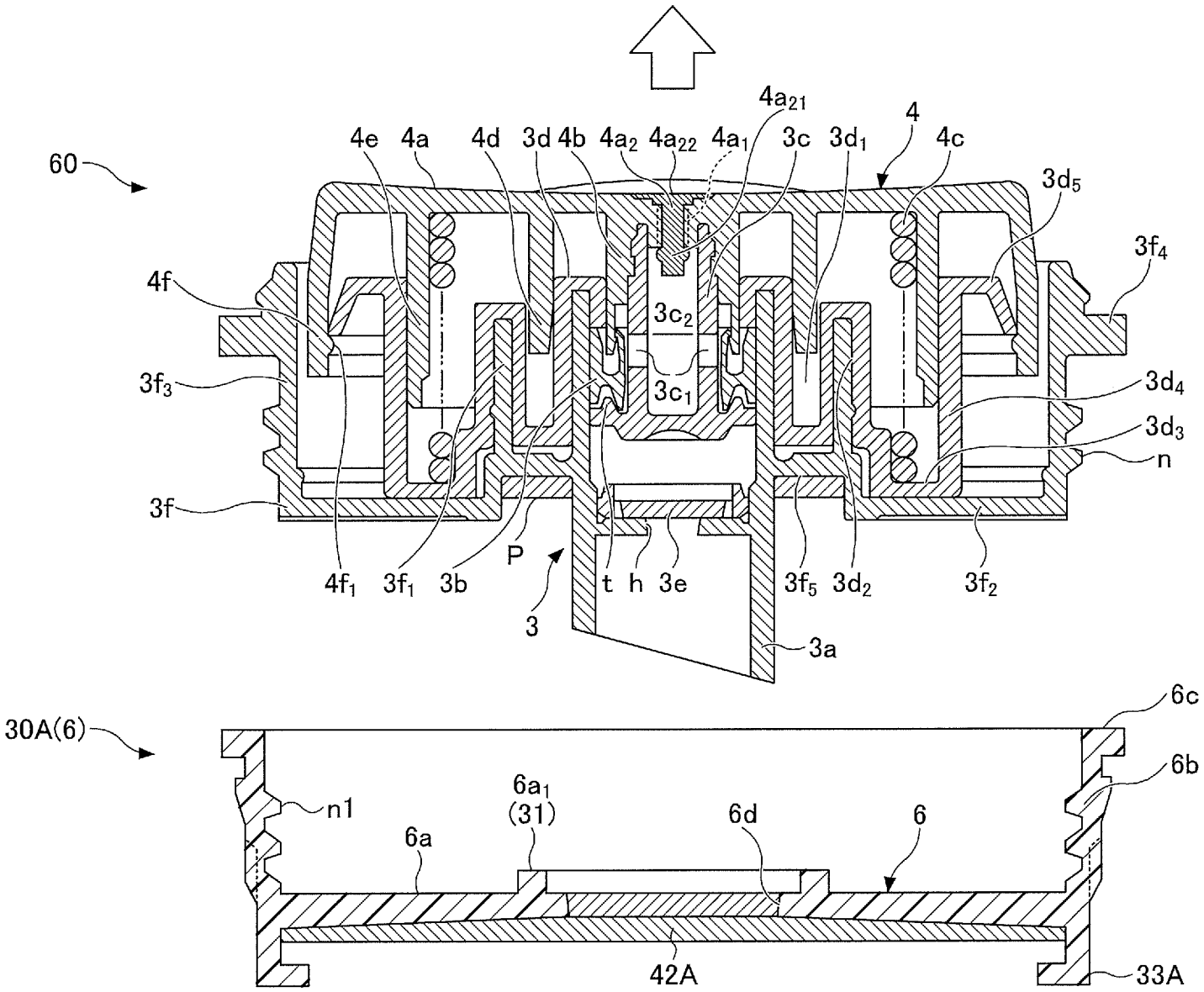
FIG. 10 is a cross sectional view of the push pump of FIG. 9.

Moreover, in this configuration, the mouth part 21 or 31 (inner lid part 6) to which the pump head 60 is attached preferably has functions of the inner lid part as illustrated in FIG. 10.

FIG. 10 illustrates a cross sectional view of the pump head of FIG. 9. As illustrated in FIG. 10, the pump head includes a pump 3 and a pressing head 4. The pump 3 is fitted on the inner side the inner lid part 6, which is an example of the mouth part 21, and the pressing head 4 activates the pump 3.

The pump 3 includes a tubular cylinder 3*a*, a piston 3*b*, a hollow stem 3*c*, a slip-out prevention cover 3*d*, and a valve body 3*e*. The tubular cylinder 3*a* has a content inlet h at a bottom part thereof. The piston 3*b* is slidably arranged inside the cylinder 3*a*. The hollow stem 3*c* is inserted through a through hole of this piston 3*b*, and an end (upper end) of the hollow stem 3*c* is connected to a casing of the pressing head 4 that will be described later. The slip-out prevention cover 3*d* is fixed to an upper open end of the cylinder 3*a*, and prevents the piston 3*b* from slipping out of the cylinder 3*a*. The valve body 3*e* is arranged inside the cylinder 3*a* at the content inlet h, a casing 3*f*, which is a three-point valve or the like opened only when the content is drawn, is integrally connected to an outer side wall of the cylinder 3*a*, and an upper surface of the casing 3*f* has a concave cross sectional shape in which each of the above described constituent members of the pump 3 are set and accommodated.

An outer edge part of the slip-out prevention cover 3*d* is integrally formed with annular grooves 3*d*1 and 3*d*2, an upward-opening annular recess 3*d*3, a cylinder 3*d*4, and a claw portion 3*d*5. The annular groove 3*d*1 is provided so as to surround the cylinder 3*a*, and opens upward and opens downward. The upward-opening annular recess 3*d*3 is provided so as to surround the annular grooves 3*d*1 and 3*d*2, and the cylinder 3*d*4, forming a spring setting portion (seating surface) that will be described later, stands at an edge part of the annular recess 3*d*3. The claw portion 3*d*5 is integrally connected to an upper end part of the cylinder 3*d*4, a tip end part of the claw portion 3*d*5 is oriented obliquely downward, and the claw portion 3*d*5 may have an annular shape, or a plurality of claw portions 3*d*5 may be provided.

The casing 3*f* is formed with a cylinder 3*f*1, a bottom wall 3*f*2, a cylinder 3*f*3, and a flange portion 3*f*4 are formed in the casing 3*f*. The cylinder 3*f*1 fits into the annular groove 3*d*2 of the slip-out prevention cover 3*d*, and is used integrally (integrally connect) with the slip-out prevention cover 3*d*. The bottom wall 3*f*2 abuts a lower surface of the annular recess 3*d*3 of the slip-out prevention cover 3*d*. The cylinder 3*f*3 rises from the edge part of the bottom wall 3*f*2, and has a threaded portion n on an outer wall thereof. The flange portion 3*f*4 abuts the flange portion 6*c* of the mouth part 21 or 31.

In addition, the pressing head 4 is formed by a disk-shaped top lid 4*a*, a cylinder 4*b*, a spring 4*c*, a guide 4*d*, a cylinder 4*e*, and a peripheral wall 4*f*.

The top lid 4*a* is a disk-shaped lid having a diameter that enables the top lid 4*a* to enter inside the cylinder 3*f*3 of the casing 3*f*, and FIG. 10 illustrates an example in which an edge part of the top lid 4*a* has a wavy shape. The cylinder 4*b* is integrally provided on a lower surface of the top lid 4*a*, and is connected at the upper end of the hollow stem 3*c* of the pump 3 via an engaging means such as undercutting. The spring 4*c* is arranged between the top lid 4*a* and the annular recess 3*d*3, and elastically supports the top lid 4*a*. The guide 4*d* hangs vertically from the lower surface of the top lid 4*a*, and is slidably inserted into the annular groove 3*d*1 of the locking cover 3*d*, to perform a positioning with the pump 3, and the guide 4*d* may have a ribbed shape or a cylindrical shape. The cylinder 4*e* hangs from the lower surface of the top lid 4*a* so as to surround the guide 4*d*, and is slidable up and down along an inner wall of the cylinder 3*d*4 of the slip-out prevention cover 3*d*. The peripheral wall 4*f* is integrally connected to the outer edge part of the top lid 4*a*, and hangs therefrom.

An inner wall of the peripheral wall 4*f* is provided with an annular protrusion 4*f*1 or a plurality of protrusions 4*f*1. The protrusion 4*f*1 engages the claw portion 3*d*5 of the locking cover 3*d*, to prevent the pressing head 4 from coming off. An urging force of the spring 4*c* is set to an extent such that the pressing head 4 does separate from the claw portion 3*d*5 of the lock cover 3*d*.

An opening 4*a*1 is formed at a center of the top lid 4*a* of the pressing head 4, and the opening 4*a*1 is blocked in a steady position not having the pressing head 4 pressed into the opening 4*a*1. A valve body 4*a*2 is provided at the center of the top lid 4*a* of the pressing head 4, to open the opening 4*a*1 only in a state where the pressing head 4 is pressed into the opening 4*a*1. The valve body 4*a*2 includes a body portion 4*a*21 that is secured in a passage of the opening 4*a*1, and a valve portion 4*a*22 that is connected in an elastically deformable manner to the body portion 4*a*21, and at least the valve portion 4*a*22 is formed of an elastic material such as a rubber or the like, or a soft material such as an elastomer.

The piston 3*b* of the pump 3 is arranged inside a space formed between a flange portion t provided at a tip end part of the hollow stem 3*c*, and a tip end of the cylinder 4*b*. Within this space, the piston 3*b* can slide very slightly by itself. When the pressing head 4 is pressed (when discharging the content), the tip end of the cylinder 4*b* abuts a rear end (upper end) of the piston 3*b*, and the piston 3*b* slides toward the inlet h of the cylinder 3*a*. On the other hand, when the pressing head 4 is restored to an initial state (when drawing the content), the flange portion t provided at the tip end part of the hollow stem 3*c* abuts a tip end (lower end) of the piston 3*b*, and the piston 3*b* slides toward the upper end of the cylinder 3*a*.

In this configuration, the mouth part 21 that becomes the inner lid part 6 is connected to the shoulder part 22 (32) forming the upper surface. A bottom wall (partition) 6*a*, an annular peripheral wall 6*b*, a flange portion 6*c*, and an opening 6*d* are provided at an inner periphery of the inner lid part 6.

The bottom wall (partition) 6*a* has a large surface area that covers the top end opening of the container body 1. The annular peripheral wall 6*b* stands at (integrally connects to) an edge part of the bottom wall 6*a*. The flange portion 6*c* is provided at a protruding end portion of the annular peripheral wall 6*b*, and abuts the flange portion 3*f*4 of the casing 3*f*. The opening 6*d* is formed at a center portion of the bottom wall 6*a*, and directs only the inlet h of the pump 3 to face toward a filling space M.

The bottom wall 6*a* of the inner lid part 6 includes functions of a partition that prevents the inside of a container body 1E from contacting the casing 3*f* of the pump 3. The inner wall of the annular peripheral wall 6*b* is provided with a threaded portion n1 that engages the threaded portion n formed on the cylinder 3*f*3 of the casing 3*f*. An outer wall of the annular peripheral wall 6*b* becomes the outer wall of the mouth part 21 or 31. Although illustrated example employs the undercutting for the engagement, the engagement may use screws. A packing P is arranged between the annular protrusion 6*a*1 of the bottom wall 6*a* and the annular recess 3*f*5 of the casing 3*f*, to maintain a fluid-tight state.

According to this configuration, the pump head 60, which is the discharge mechanism having the airless characteristics, is attached to the mouth part 21 (31) during the pre-shipping manufacturing process. For this reason, oxygen is prevented from making contact with the content inside the container body 1 as much as possible, and it is possible to maintain a state where the denaturation caused by oxidation is minimized until the content is discharged.

In addition, according to this configuration, because the container body 1 shrinks according to the remaining amount of the content while maintaining the sealed state, it is possible to confirm the remaining amount of the content at a glance, by checking the shrunk state of the container body 1 from outside the outer container 7 that is transparent in its entirety or in part.

In the case of this configuration, because it is a precondition that the content remains on the top lid 4*a* that is a flat dish-like discharge surface, a high-viscosity liquid (fluid), such as a cosmetic (foundation cosmetic, cosmetic for base makeup, cosmetic for point makeup), a solid perfume, a condiment, or the like having a predetermined viscosity, for example, is preferably contained as the content.

<Attaching Discharge Mechanism (3: Pressure Head With Tray)>

FIG. 11 illustrates an example in which a pump head with a tray is attached, as the discharge mechanism, to the mouth part of a two-layered container 100F of the present invention.

The pump head 60F with the tray illustrated in FIG. 11 is a modification of the pump head 60 illustrated in FIG. 9, and in this configuration, the pump head with the tray that allows visual confirmation of raised and lowered states of a tray 61 at the upper surface from the outside, is attached as the discharge mechanism having the airless characteristics. In other words, in the configuration of FIG. 11, a lower part of the pressing head 4F extends like a stem as compared to FIG. 10. Moreover, in this configuration, a lid 301 with a hinge 302 is attached to a portion of a pump 3F so that the lid 301 can open and close, and the lid 301 can cover the upper portion of the tray 61.

Further, in this configuration, because the tray 61 has a concave shape that caves in, the low-viscosity content can be retained on the tray 61. For example, this configuration is suitable for use when the discharged content is to be impregnated into a sponge, puff, cotton, tissue, kitchen paper, or the like.

According to this configuration, the pump head 60F with the tray, which is the discharge mechanism having the airless characteristics, is attached to the mouth part 21 (31) during the pre-shipping manufacturing process. For this reason, oxygen is prevented from making contact with the content inside the container body 1 as much as possible, and it is possible to maintain a state where the denaturation caused by oxidation is minimized until the content is discharged.

In the configurations of FIG. 8, FIG. 9, and FIG. 11 to which the first through fourth embodiments are applicable, the check valve is provided in the discharge mechanisms 50, 60, and 60F that are attached to the mouth part. For this reason, even if the container is left for a while after the container is opened and the content therein is used halfway, the air does not enter the container, and the properties of the content (contained material) hardly change. Further, it is possible to prevent the air from entering the container body even during use when the pump of the discharge mechanisms 50, 60, and 60F in FIG. 8, FIG. 9, and FIG. 11 are driven to perform a discharge operation to discharge the content. For this reason, the properties of the content hardly change even during use of the container.

The material used for the discharge mechanisms 50, 60, and 60F simply need to withstand the discharge operation and the operation of the check valve, because the content pass through the cap 54 or inside the pump 3 only during use. Further, the material used for the discharge mechanisms 50, 60, and 60F is preferably a plastic or the like including a metal layer or an inorganic layer having excellent air blocking properties, in order to prevent the air from entering inside the container body 1 through the discharge mechanisms 50, 60, and 60F.

In the two-layered container, the type of discharge mechanism may be selected according to the viscosity of the content contained in the container body 1. The discharge mechanisms for the anticipated viscosities of the content, in an order starting from the low viscosity, include the configuration of FIG. 8 (airless pump (for droplet and atomized injection)<configuration of FIG. 11 (pump head with tray 60F)=<configuration of FIG. 8 (airless pump (for fluid extrusion)<configuration of FIG. 9 (pump head 60)).

Thus, the two-layered containers of the embodiments described above are suitable for containing liquid materials need to avoid light transmission and oxygen contact, because the containers are made of the material having the air blocking properties and optically non-transparent properties.

When the contained liquid material is discharged and used, the container body of the container undergoes plastic deformation, and when the liquid material in the container body runs out, the container body collapses to a thin state due to shrinking in the vertical direction, and for this reason, there is no need to further compress the container body even if the inner container is removed from the outer container.

Moreover, because the container body that shrinks inside the outer container is deformed with a good appearance along the fold creases, the deformation of the container body will not appear unsightly even if the outer container is transparent.

<Three-Layered Container>

Figure 12:
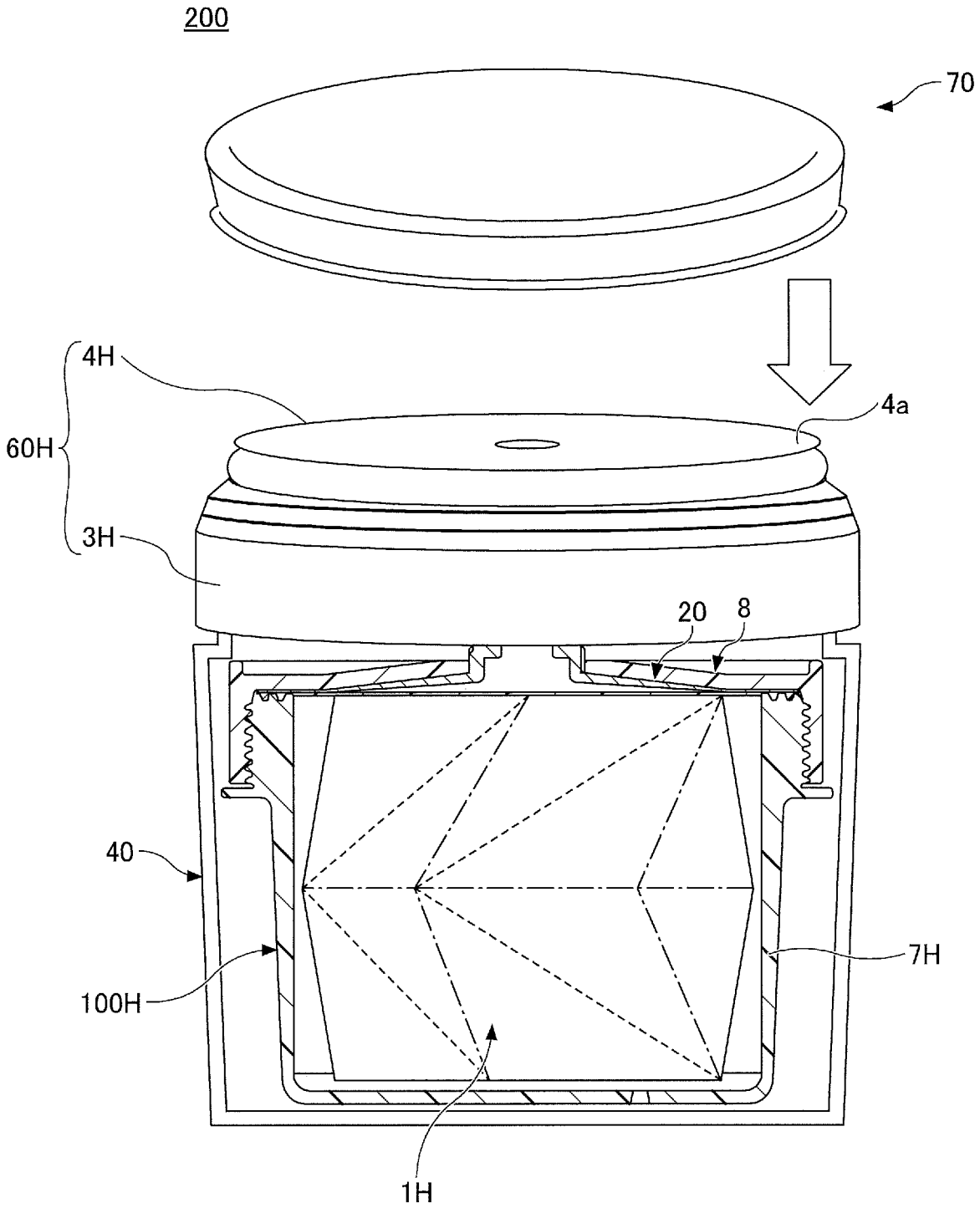
FIG. 12 is a general view of a three-layered container including the two-layered container according to the present invention.

FIG. 12 is a general view of a three-layered container including the two-layered container according to the present invention.

A three-layered container 200, which is a multilayered container according to one embodiment of the present invention, includes a two-layered container 100H, an outer casing 40, and a push pump 60H. The three-layered container 200 may additionally include a lid part 70.

The two-layered container that can be accommodated in the three-layered container 200 may be the two-layered containers 100, 100A, 100G, 100B, and 100C having the convex mouth part 21 or 31 described above, or a two-layered container having a concave mouth part. The two-layered container 100H includes least a container body 1H, and the mouth part 21 or 31.

The push pump 60H, which is a discharge mechanism, fits to an upper end of the outer casing 40, and pushes the content contained in the container body 1 of the two-layered container 100 upward while preventing the air from entering the container body during use. The push pump 60H includes a pressing head 4H and a pump 3H.

Because the three-layered container according to the present invention includes the two-layered container as described above, the three-layered container 200 can ensure the air blocking properties because a container body 1H of the two-layered container 100H includes a metal layer or an inorganic layer, and the closing film 41 or the metal film covering the mouth part 21 of the lid part 20 (refer to FIG. 13B) includes a metal layer.

In addition, the container body 1H may be formed of a metal layer, or the container body 1H may be formed of a transparent inorganic layer, and an outer container 7H and/or the outer casing 40 may be formed to include an opaque resin, to provide the light blocking properties.

Figure 13A:
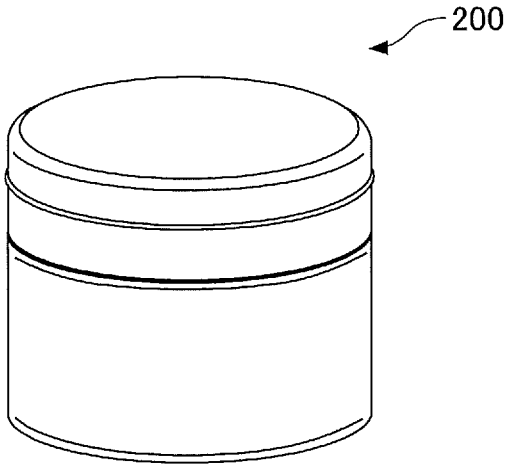
FIG. 13A is an outline view of the three-layered container of FIG. 12 in a state where a lid part is closed.
Figure 13B:
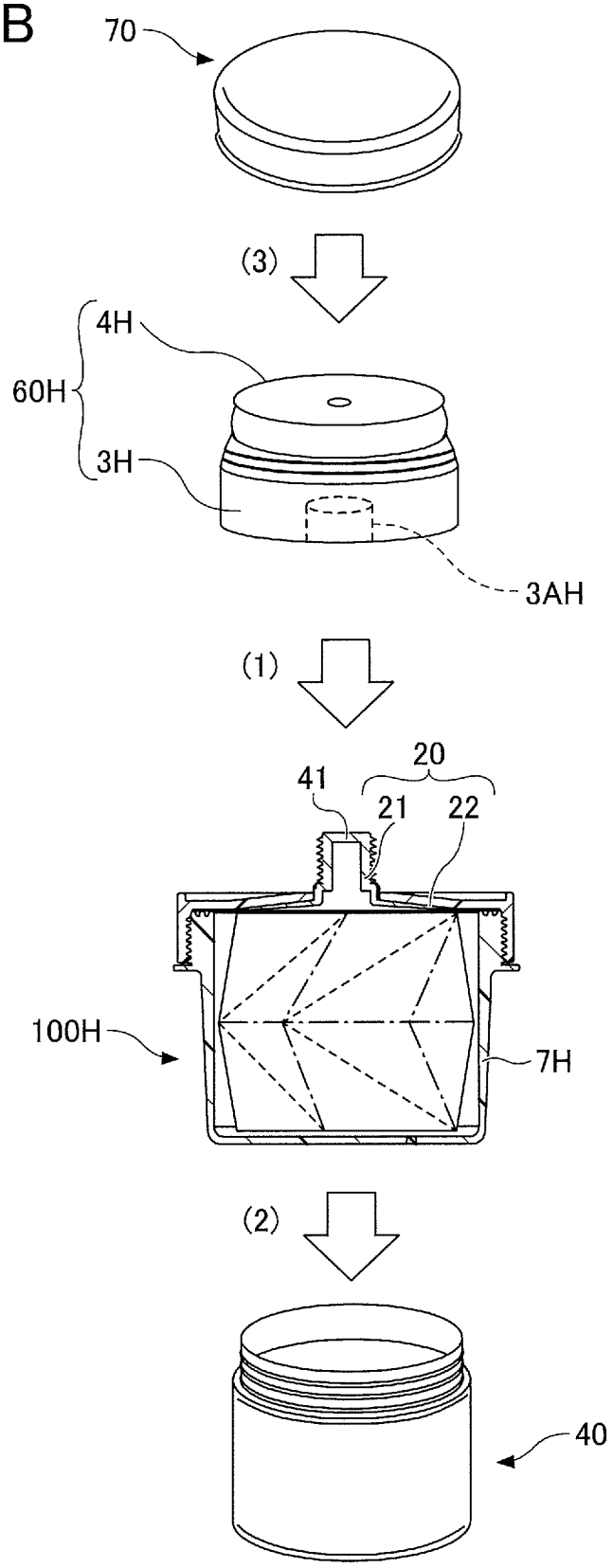
FIG. 13B is an exploded view for explaining the three-layered container of FIG. 13A.

FIG. 13A and FIG. 13B are diagrams for explaining a configuration example of the three-layered container of FIG. 12, where FIG. 13A is an outline view of the three-layered container 200 in a state where the lid part 70 is closed, and FIG. 13B is an exploded view of FIG. 13A.

As illustrated in FIG. 13B, in this configuration, the two-layered container 100H contained in the three-layered container 200 includes the mouth part 21 that stands upward from the shoulder part 22 at the lid part 20. For example, any one of the two-layered containers 100, 100A, 100G, 100B, and 100C of FIG. 1, FIG. 2, FIG. 3, FIG. 6, and FIG. 7 may be applied as is.

In addition, according to this configuration, a cylinder (concave cylinder) 3AH is configured to be recessed with respect to a lower surface of the pump 3H of the push pump 60H.

By fitting the recessed cylinder 3AH of the push pump 60H and the mouth part 21 of the two-layered container 100 together upon assembly in (1), the push pump 60H communicates with the container body 1H.

Then, in (2), while accommodating the connected push pump 60H and the two-layered container 100 in the outer casing 40, an outer periphery of the pump 3H of the push pump 60H to which the two-layered container 100H is attached, is attached to the outer casing 40.

Finally, in (3), the lid part 70H is attached to the top of the push pump 60H.

After all elements are assembled, as illustrated in FIG. 13A, from a view point of beautiful appearance, it is preferable that the side surface of the outer casing and the side surface of the push pump are formed to lie approximately on the same plane, and the shape is cylindrical or polygonal in the connected state of the outer casing and the push pump, for example.

In this embodiment, similar to FIG. 10, it is preferred, for example, that the flange portion 3*f*4 of the pump 3H fits into an end part of the outer casing 40, and a protrusion is attached to an upper end of an inner side of the side surface of the outer casing.

FIG. 12, FIG. 13A, and FIG. 13B illustrate an example in which the two-layered container 100H having the same configuration as the two-layered container 100 illustrated in FIG. 1 is accommodated inside the three-layered container 200. However, in the two-layered container accommodated inside the three-layered container 200, the container body 1H may be any one of the container bodies 1, 1A, 1B, and 1G, and the mouth-side member provided on the two-layered container may be any one of the lid parts 20 and 20B and the upper pressing part 30, the lid part 20 and the upper pressing part 30 having the recessed mouth parts 21 and 31.

In the three-layered container 200 illustrated in FIG. 12, FIG. 13A, and FIG. 13B, because it is a precondition that the content remains on the top lid 4*a* that is the flat dish-like discharge surface, a high-viscosity liquid (fluid) that is contained as the content is preferably a cosmetic (foundation cosmetic, cosmetic for base makeup, cosmetic for point makeup), a solid perfume, a condiment, or the like having a predetermined viscosity, for example.

In this embodiment, similar to FIG. 4 and FIG. 5, by shrinking the container body 1H of the inner container so as to reduce the volume according to the remaining amount of the content, the three-layered container 100H having the three-layer structure, which is a multilayered container of the present invention, can continue to protect the content from exposure to the air, and maintain the quality of the content until the end.

When the three-layered container 200 is configured as in the above described embodiment, it is preferable that the outer container 7H of the two-layered container 100H is made transparent in its entirety, and the outer casing 40 accommodating the two-layered container 100H is made transparent at least in part, for example, so that the shrinking of the container body 1H, included in the two-layered container 100H accommodated inside the three-layered container 200, is visually recognizable from the outside. When a part of the outer casing 40 is made transparent, it is preferable to provide a slit that extends in the vertical direction to enable visual confirmation of the shrinking of the container body 1H from the outside.

Alternatively, the outer casing 40 and/or the outer container 7H of the two-layered container 100H may be formed entirely of an opaque material. In this case, at least the container body 1H on the inside is not visible from the outside, to enable a design that hides the deformation of the container body 1H.

In the three-layered container of FIG. 12, FIG. 13A, and FIG. 13B, the two-layered container 100H is preferably detachably attached to the outer casing 40. In this case, when the inside of the container body 1H becomes empty, or the liquid material inside the container body 1H runs short, the two-layered container 100H can be replaced with a new two-layered container 100H filled with the liquid material. The outer casing 40 and the push pump 60H may continue to be used. In addition, if the inside of the container body 1 of the two-layered container 100H becomes empty, or the liquid material inside the container body 1H runs short, the two-layered container 100H may once be removed from the outer casing 40 to refill the liquid material, and then be reattached to the outer casing 40.

In addition, in the two-layered container 100H contained in the three-layered container 200, the innermost container body 1H shrinks, while the outermost outer casing 40 and outer container 7 maintain the standing stage. For this reason, when a product label or the like is affixed to the side surface of the outer casing 40, for example, it is possible to maintain the product label in a visibly recognizable state even at the end of use. Furthermore, when the inside of the container body 1H becomes empty, or the liquid material inside the container body 1H runs short after use, and the entire two-layered container 100H is to be replaced, the product label or the like affixed to the outer container 7H of the two-layered container can prevent filling of an erroneous content into the two-layered container 100H that is collected and thereafter reused, when refilling the two-layered container 100H at a factory or the like.

Although preferred embodiments of the present invention are described above in detail, the present invention is not limited to the specific embodiments described above, and various variations and modifications may be made within the scope of the subject matter of the present invention as recited in the claims.

This application is based upon and claims priority to Japanese Patent Application No. 2018-113137, filed Jun. 13, 2018, the entire contents of which are incorporated herein by reference.

DESCRIPTION OF THE REFERENCE NUMERALS

1, 1A, 1B, 1C, 1G Container body
2 Mouth-side member
3, 3G Pump
3AG Cylinder (convex cylinder)
3AH Cylinder (concave cylinder)
4 Pressing head
5, 5A, 5B, 5C Inner container
7, 7B, 7C, 7G, 7H Outer container
8 Upper fixing part (fixing part)
10 Side surface
17 Bottom surface (lower surface)
18, 18B, 18C Flange
19 Upper surface
20, 20B Lid part
21 Mouth part
22 Shoulder part
30 Upper pressing part
31 Mouth part
32 Shoulder part
40 Outer casing
41 Closing film (metal film)
42 Metal film
401 Side surface
402 Bottom surface
50 Airless pump (discharge mechanism)
60, 60F Pump head (discharge mechanism)
60H Push pump (discharge mechanism)
70, 70G, 70H Lid part
90 Clasp (fixing part)
100, 100A, 100B, 100C, 100D, 100E, 100F, 100G, 100H Two-layered container
200 Three-layered container
703, 704 Fitting protrusion (threaded convex portion)
802 Lid peripheral wall (rim)
803, 804 Fitting groove (threaded recess)
S1, S2, N1, N2 Unit

The invention claimed is:

1. A multilayered container comprising:

an inner container configured to contain content; and an outer container configured to replaceably accommodate the inner container, wherein the inner container has a side surface formed with a plurality of folded pleats contractable and expandable in a vertical direction, so that the inner container is shrinkable along the plurality of folded pleats inside the outer container, the inner container is made of a flexible material that is shrinkable when the inner container is depressurized, and includes a metal layer or an inorganic layer, and an airless discharge mechanism, configured to discharge the content in response to being driven, including a mechanism configured to prevent air from entering the inner container when discharging the content, is attached to an upper surface of the inner container, the side surface of the inner container includes first folded pleats formed by each side of parallelograms, and second folded pleats formed by diagonal lines of the parallelograms, the first and second folded pleats form a plurality of units stacked in the vertical direction, so that vertically adjacent units share a top side and a bottom side of adjacent parallelograms, mountain-fold creases or valley-fold creases of the first and second folded pleats in the plurality of units are formed by each side of parallelograms, and diagonal lines of the parallelograms, a decrease in an amount of the content in the inner container, corresponding to an amount of the content discharged from the airless discharge mechanism in response to being driven, continuously depressurizes the inner container and causes the plurality of folded pleats to contract, thereby causing the mountain-fold creases to protrude outward and the valley-fold creases to fold inward and collapse the first and second folded pleats, to thereby shrink the inner container and maintain the inner container in a shrunk state, the side surface is vertically symmetrical for each of the plurality of units, such that the side surface is configured to be vertically crushed without changing positions of an upper end and a lower end of the side surface as the inner container shrinks, an uppermost unit among the plurality of units of the inner container includes a flange, provided at the upper end of the side surface of the inner container, the upper end of the side surface of the inner container and one of the diagonal lines meet at a point on the flange that is connected to the outer container, and the flange extends radially outward in a horizontal direction from the point toward an outer edge of the multilayered container.

2. The multilayered container as claimed in claim 1, further comprising:

a lid part attached to the flange, and including a mouth part fittable with respect to the airless discharge mechanism and a shoulder part surrounding the mouth part, wherein the lid part includes a metal layer.

3. The multilayered container as claimed in claim 2, wherein the mouth part includes a metal film configured to close the mouth part until the mouth part is fitted with the airless discharge mechanism, or until immediately prior to being opened.

4. The multilayered container as claimed in claim 2, further comprising:

a fixing part configured to fix the lid part with respect to the outer container, wherein the flange of the inner container, and an edge part of the shoulder part of the lid part, are sandwiched between the fixing part and a top surface of the side surface of the outer container.

5. The multilayered container as claimed in claim 1, further comprising:

an upper pressing part including a mouth part, a shoulder part surrounding the mouth part, and a peripheral wall part standing downward from an edge part of the shoulder part; and a metal film configured to cover the entire lower surface of the upper pressing part, wherein the outer container includes a flange, provided at the upper end of the side surface of the inner container, and extending outward in the horizontal direction, and wherein the peripheral wall part of the upper pressing part fits over and holds the flange of the inner container, and the flange of the outer container, from outer peripheries thereof, to seal the inner container.

6. The multilayered container as claimed in claim 5, wherein the upper pressing part is attached to fit over and hold the flange of the inner container, the metal film, and the flange of the outer container, after the inner container is filled with the content, and the mouth part is closed by the metal film until the mouth part is fitted with the airless discharge mechanism, or until immediately prior to being opened.

7. A multilayered container having a three-layer structure, comprising:

the multilayered container according to claim 1 having a two-layer structure; and an outer casing enclosing an outer side of the outer container of the multilayered container having the two-layer structure, wherein the airless discharge mechanism is fitted to an upper end of the outer casing.

8. The multilayered container as claimed in claim 7, wherein a side surface of the outer casing and a side surface of the airless discharge mechanism are formed to lie approximately on the same plane, and the outer casing and the airless discharge mechanism form a cylindrical shape or a polygonal shape in a connected state.

9. A multilayered container comprising:

an inner container, configured to contain content, and having an upper surface, a side surface, and a bottom surface;

an outer container configured to replaceably accommodate the inner container;

an airless discharge mechanism, attached to the upper surface of the inner container, and configured to discharge the content in the inner container in response to being driven, wherein the side surface of the inner container has a plurality of folded pleats contractable and expandable in a vertical direction, so that the inner container is shrinkable along the plurality of folded pleats inside the outer container, the inner container is made of a flexible material that is shrinkable when the inner container is depressurized, the inner container includes one or a plurality of layers having at least one of air blocking properties and light blocking properties formed on the side surface and the bottom surface of the inner container, the airless discharge mechanism includes a mechanism configured to prevent air from entering the inner container when discharging the content, the side surface of the inner container includes first folded pleats formed by each side of parallelograms, and second folded pleats formed by diagonal lines of the parallelograms, the first and second folded pleats form a plurality of units stacked in the vertical direction, so that vertically adjacent units share a top side and a bottom side of adjacent parallelograms, mountain-fold creases or valley-fold creases of the first and second folded pleats in the plurality of units are formed by each side of parallelograms, and diagonal lines of the parallelograms, a decrease in an amount of the content in the inner container, corresponding to an amount of the content discharged from the airless discharge mechanism in response to being driven, continuously depressurizes the inner container and causes the plurality of folded pleats to contract, thereby causing the mountain-fold creases to protrude outward and the valley-fold creases to fold inward and collapse the first and second folded pleats, to thereby shrink the inner container and maintain the inner container in a shrunk state, the side surface is vertically symmetrical for each of the plurality of units, such that the side surface is configured to be vertically crushed without changing positions of an upper end and a lower end of the side surface as the inner container shrinks, an uppermost unit among the plurality of units of the inner container includes a flange, provided at the upper end of the side surface of the inner container, the upper end of the side surface of the inner container and one of the diagonal lines meet at a point on the flange that is connected to the outer container, and the flange extends radially outward in a horizontal direction from the point toward an outer edge of the multilayered container.

10. The multilayered container as claimed in claim 9, further comprising:

a lid part attached to the flange, and including a mouth part fittable with respect to the airless discharge mechanism and a shoulder part surrounding the mouth part, wherein the lid includes a metal layer.

11. The multilayered container as claimed in claim 10, wherein the mouth part integrally includes a closing film configured to close the mouth part until the mouth part is fitted with the airless discharge mechanism, or until immediately prior to being opened.

12. A multilayered container having a three-layer structure, comprising:

the multilayered container according to claim 9 having a two-layer structure; and an outer casing enclosing an outer side of the outer container of the multilayered container having the two-layer structure, wherein the airless discharge mechanism is fitted to an upper end of the outer casing.

* * * * *